US010603817B2

(12) United States Patent
Gildersleeve et al.

(10) Patent No.: US 10,603,817 B2
(45) **Date of Patent: *Mar. 31, 2020**

(54) FULLY AUTOMATED MOLD CHANGE WITH PRODUCT HEIGHT CHANGE

(71) Applicant: Columbia Machine, Inc., Vancouver, WA (US)

(72) Inventors: Stacy Gildersleeve, Woodland, WA (US); Allen Aaseth, Woodland, WA (US)

(73) Assignee: Columbia Machine, Inc., Vancouver, WA (US)

( * ) Notice: Subject to any disclaimer, the term of this patent is extended or adjusted under 35 U.S.C. 154(b) by 1014 days.

This patent is subject to a terminal disclaimer.

(21) Appl. No.: 14/991,182

(22) Filed: Jan. 8, 2016

(65) Prior Publication Data

US 2017/0197335 A1 Jul. 13, 2017

(51) Int. Cl.
*B28B 3/00* (2006.01)
*B28B 17/00* (2006.01)
*B30B 15/02* (2006.01)

(52) U.S. Cl.
CPC ..... *B28B 17/009* (2013.01); *B28B 17/0063* (2013.01); *B30B 15/028* (2013.01)

(58) Field of Classification Search
CPC .... B28B 17/009; B28B 17/063; B30B 15/028
See application file for complete search history.

(56) References Cited

U.S. PATENT DOCUMENTS 3,184,818 A * 5/1965 Crile ..... B28B 13/023 425/135
3,918,280 A * 11/1975 Davis ..... B21D 45/00 72/20.5
5,952,015 A * 9/1999 DeWyre ..... B28B 17/009 29/428
10,245,757 B2 * 4/2019 Gildersleeve ..... B28B 17/009

* cited by examiner

*Primary Examiner* — Galen H Hauth
(74) *Attorney, Agent, or Firm* — Schaffer IP Law, LLC

(57) ABSTRACT

An automated mold change system, for use with a concrete products machine of a type having a products forming section and a feedbox assembly section, includes a mold exchange assembly coupled to an underside of the feedbox assembly section and vertically moveable therewith, a mold transfer assembly on an opposed side of the products forming section from the feedbox assembly section, and mounts on the products forming section configured to retain a mold assembly thereon. A mold exchange path runs axially between the mold exchange assembly and the mounts on the products forming section and intersects a mold transfer path of the mold transfer assembly at a load-unload position, wherein the mold exchange assembly is configured to lift a mold off of the mounts and onto the mold transfer assembly at the load-unload position.

19 Claims, 13 Drawing Sheets

FULLY AUTOMATED MOLD CHANGE WITH PRODUCT HEIGHT CHANGE

BACKGROUND OF THE INVENTION

1. Field of the Invention

This invention relates generally to concrete product making machinery and more particularly to structures for assisting in the exchange of one mold box with another within a concrete products forming machine (CPM+).

2. Description of the Prior Art

Concrete Products Machines are complex machines capable of forming concrete products of varying shapes and sizes quickly and in such a way that the freshly formed concrete can be transported to a curing room for hardening without damage to the product. Concrete products come in a variety of sizes, shapes, and structural requirements which result in different concrete mix designs, ingredients, molds configurations, and resultant settings of the machine. Ingredients range widely worldwide and each change to the mix design requires changes to the forming machine settings. Aggregates can include volcanic cinders, crushed rock of many types, natural river rock, expanded clay and shale, and power station waste fly ash to name a few. Likewise, many different types of cement are used as a binder with color oxides and admixes of many types. Finished product shapes, sizes, and heights all require separate molds that are used in the forming machine and each requires different settings of the forming machine. And finally, structural requirements of the finished products change from product to product. A concrete paver may require extremely high densities, strengths, and resistance to liquid absorptions. A light weight masonry unit may have a low minimum strength requirement with a maximum desired unit weight. An architectural masonry unit will require uniform texture of the exposed face throughout the length and width of the exposed unit face. All these variables require unique adjustments and machine settings to form finished products properly.

Prior art machines for forming concrete products within a mold assembly include a product forming section comprising a stationary frame, an upper compression beam and a lower stripper beam. The mold assembly includes a head assembly that is mounted on the compression beam, and a mold box that is mounted on the frame and receives concrete material from a feed drawer. An example of such a system is shown in U.S. Pat. No. 5,807,591 which describes an improved concrete products forming machine (CPM) assigned in common to the assignee of the present application and herein incorporated by reference for all purposes.

In use, the feed drawer moves concrete material over the top of the mold box and dispenses the material into the contoured cavities of the mold box. The feed drawer typically includes an agitator assembly within the drawer that operates to break up the concrete and improve its consistency prior to dropping it into the mold. As the concrete material is dispensed, a vibration system shakes the mold box to spread the concrete material evenly within the mold box cavities in order to produce a more homogeneous concrete product. A wiper assembly, mounted to the front of the feed drawer, acts to scrape excess concrete from the shoes when the feed drawer is moved to an operative position above the mold box.

After the concrete is dispensed into the mold cavities, the feed drawer retracts from over the top of the mold box. A spreader, bolted separately to the front of the feed drawer, scrapes off excess concrete from the top of the mold when the feed drawer is retracted after filling the mold cavities.

The compression beam then lowers, pushing shoes from the head assembly into corresponding cavities in the mold box. The shoes compress the concrete material during the vibration process. After compression is complete, the stripper beam lowers as the head assembly pushes further into the cavities against the molded material. A molded concrete product thereby emerges from the bottom of the mold box onto a pallet and is conveyed away for curing and a new pallet moved in its place beneath the underside of the mold box.

The mold box and head assembly are matched together and configured to form concrete products in a specific shape, size, and number. Each product configuration requires a different mold. When the operator desires the CPM to produce products in different configurations, the mold box must be detached from mounts on the CPM and removed along with the head assembly. A different mold box and head assembly must then be moved into place and mounted within the CPM.

The business model has changed from a time where concrete products plants used to have a relatively narrow product offering and finished products were normally made in large production runs for stock storage in a yard. Currently, production plants are required to offer a wide range of finished products in both product configuration and color and rather than producing large quantities for stocking purposes these plants now fill orders in a 'just in time' production mode. This requires quick product change-over in the production plant and quick production startups of new products.

Conventional methods for changing mold assemblies in a CPM are typically labor intensive and result in a lot of machine downtime, leading to lost revenue. This is further complicated when exchanging mold assemblies for products of one height with mold assemblies for products of another. Product height changes thus result in even more downtime as various components of the CPM are adjusted to accommodate such a change.

Accordingly, there is need for an improved system and method for better automating the process for changing mold assemblies within a concrete products forming machine that minimizes these drawbacks.

SUMMARY OF THE INVENTION

A mold change process, according to teachings of the invention, is initiated in the following fashion. A new mold assembly is moved by forklift and set in place on one of the mold transfer cassettes on the mold transfer assembly. This is done while the concrete products machine is still in production using a mold assembly of a different product height. The new mold assembly product identification is selected and entered at the operator control station HMI screen prior to starting the mold change process. This identifies the machine parameters that will be automatically set to accept the new mold assembly and to operate the machine properly to produce the new concrete product.

The concrete products machine is taken out of automatic mode and the machine comes to a stop at the end of machine cycle. The automatic mold change process is initiated by depressing a start button on the HMI screen. The compression beam assembly raises off the compression beam stop assembly stop blocks and the stop blocks are retracted out of the way. The compression beam assembly now lowers to a position where the mold head assembly rests on the mold box assembly. At the same time, the mold transfer assembly moves to a position to accept the mold assembly currently in the machine.

Both the mold box assembly and the mold head assembly are unclamped from the machine. At the same time, the feed drawer frame assembly lowers to a position to allow the mold extractor fork of the mold extractor assembly to extend forward and below the mold box assembly. Once the rear feed drawer assembly has reached this lowered position, the mold extractor fork of the mold extractor assembly extends to a position under the mold assembly to raise the mold assembly vertically up and off the machine die supports.

When the clamps for the mold head assembly have disengaged, the compression beam assembly raises to a position which allows raising the mold assembly off the die supports without interference. When the clamps for the mold box assembly have disengaged, the rear feed drawer assembly raises, allowing the mold extractor fork of the mold extractor assembly to lift the mold assembly off the die supports.

Once the mold assembly has raised to a position to clear the mold alignment dowels in the die supports, the mold extractor arm of the mold extractor assembly extends to a position aligned with the mold transfer cassette of the mold transfer assembly. The rear feed drawer assembly is lowered, which places the mold assembly onto the mold transfer cassette. When the mold extractor fork has lowered enough to clear the bottom of the mold box assembly, the mold extractor arm retracts to allow the mold transfer assembly to move.

The mold transfer assembly moves the mold transfer carriage assembly to a new position that aligns the new mold assembly with the machine. The mold extractor arms extend to align the mold extractor fork with the new mold assembly. The rear feed drawer assembly then raises, allowing the mold extractor fork to lift the new mold assembly off the mold transfer cassette. The mold extractor arm then retracts to a position which aligns the new mold assembly with the die supports.

The rear feed drawer assembly lowers which allows the mold extractor fork to set the new mold assembly onto the die supports. Once the mold extractor forks are clear of the bottom of the mold box assembly, the mold extractor arm retracts to the fully retracted position of the mold extractor assembly. At the same time, (1) the compression beam assembly lowers to a position to contact the top of the new mold head assembly, (2) the mold transfer assembly moves to the home position next to the machine, and (3) the feed drawer frame assembly raises to the new feed drawer vertical dispensing position for the new mold assembly.

Clamps engage the new mold box assembly to the die supports and concurrently clamps engage the new mold head assembly to the compression beam assembly. The compression beam assembly raises the mold head assembly and the compression beam stop assemblies extend placing the stop blocks in position. The compression beam assembly is lowered to a rest position on the compression beam stop blocks.

The machine settings for the new mold assembly have already been entered into the operating system at the start of the mold change process. The machine is placed into automatic operation by pulling out the CPM+ automatic push/pull button on the operator main control console and the machine cycle start is initiated.

Novel and useful features of the invention enable improved automated performance, particular with mold changes within a concrete products forming machine.

The fully automated aspect of the entire mold change process includes automatically setting the machine for production of a different concrete product and a different height product without any manual intervention or manual adjustment to the machine or the mold change process is unique. Furthermore, using the vertical movement of the feed drawer frame assembly to raise and lower the mold assembly eliminates additional actuators required to raise and lower the mold assemblies.

Additionally, the mold transfer cassettes in the mold transfer assembly is unique in that operators can either place and remove mold assemblies in the mold transfer cassettes or they can transfer mold assemblies in the mold transfer cassettes by removing the cassettes with mold assemblies from the mold transfer carriage assemblies. The mold transfer assembly as described maintains movement and actuation in only one plane, which simplifies the assembly.

The compression beam stop assemblies are a unique feature as they allow for a safe rest position for the compression beam assembly but are automatically moved out of the way during the mold change process. Previously these stops were mechanical parts that were physically changed on the machine with stops of different heights for different mold heights.

In other aspects, the invention consists of a single axis of motion mold transfer carriage assembly that transports one or more removable mold cassette assemblies adapted to carry mold assemblies.

The foregoing and other objects, features and advantages of the invention will become more readily apparent from the following detailed description of a preferred embodiment of the invention that proceeds with reference to the accompanying drawings.

DETAILED DESCRIPTION

Figure 1:
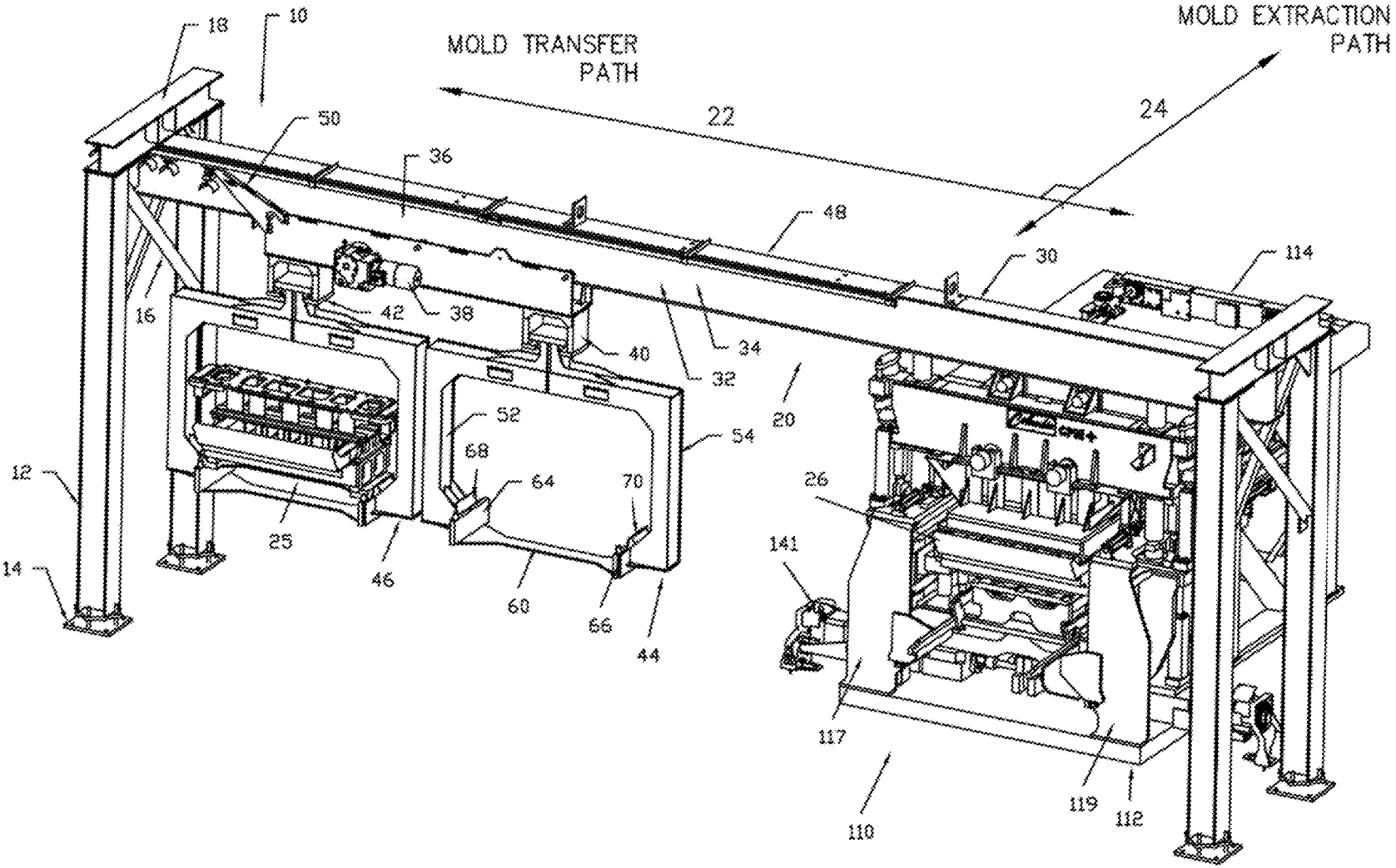
FIG. 1 is a perspective view of an augmented concrete products forming machine (CPM+) incorporating mold change and transfer structures as described within the invention shown in a first, home position.

FIG. 1 illustrates a mold transfer assembly, also referred to as a carriage assembly 10, as constructed according to preferred embodiments of the invention. Mold transfer assembly 10 includes two pairs of uprights, such as legs 12, positioned on either side of the assembly. Each upright 12 includes a footing 14, with the pair coupled together via cross-bracing struts 16 and a top-mount cross beam 18. An I-beam 20 is coupled to the underside of each cross beam 18 to thereby tie the uprights and cross beams together. As explained further below, the I-beam 20 forms a track along which a mold assembly, such as mold assembly 25, is carried by the mold transfer assembly and therefore defines an axial mold transfer path 22. The assembly 10 is set up so that the mold transfer path 22 is perpendicular to a mold extraction path 24 along which a mold assembly, such as assembly 26, is removed from the concrete products forming machine 110. These structures combined form the structural frame of the mold transfer assembly 10.

Track I-beam 20 includes a top flange 30 and spaced, parallel bottom flange 32 coupled together via a vertical member 34. A mold transfer carriage assembly 36 rolls atop the bottom flange 32 of I-beam 20 under power of motor 38 and carries a pair of hangers 40, 42 from which a pair of mold cassette assemblies 44, 46 hang in fixed relation to one another. A downwardly directed, secondary track 48 sits atop the top flange 30. A tow trolley 50, coupled to a rear of the mold transfer carriage assembly 36 runs within a slot on track 48 in parallel relation with the mold transfer path 22.

FIG. 1 illustrates the mold transfer assembly 10—and particularly the cassette assemblies 44, 46—in a home or retracted position. In such a position, the cassettes 44, 46 are moved away from the mold extraction path 24 to the far left position. Mold assembly 26 is shown already installed in CPM+ 110 to form molded concrete products of a first-type of configuration and size. The mold assembly 25 shown mounted within cassette 46 would typically have a different configuration and size from mold assembly 26. As will be described below, the cassettes 44, 46 move via the mold transfer carriage assembly 36 along I-beam 20 to positions adjacent CPM+ 110 to first receive the currently mounted mold assembly 26 within currently empty cassette 44, and then deliver the second mold assembly 25 to the CPM+ 110. This loading process involves instructions for moving right from a retracted position to a first loading position (FIG. 6), loading the mold assembly 26 onto cassette 44, then moving further right to a second loading position (FIG. 13), and then delivering the second mold assembly 25 to the CPM+ 110.

The mold transfer carriage assembly has three discreet positions. The first position is in the fully retracted position. In this first position only one of the mold cassette assemblies contains a mold assembly. The second position is when the empty mold cassette assembly is located directly in front of the concrete products forming machine ready to receive the mold assembly being extracted from the concrete products forming machine by the mold extractor assembly. The third position is when the mold cassette assembly containing the new mold assembly is located directly in front of the concrete products forming machine allowing the mold extractor assembly to insert the new mold assembly into the concrete products forming machine.

Figure 6:
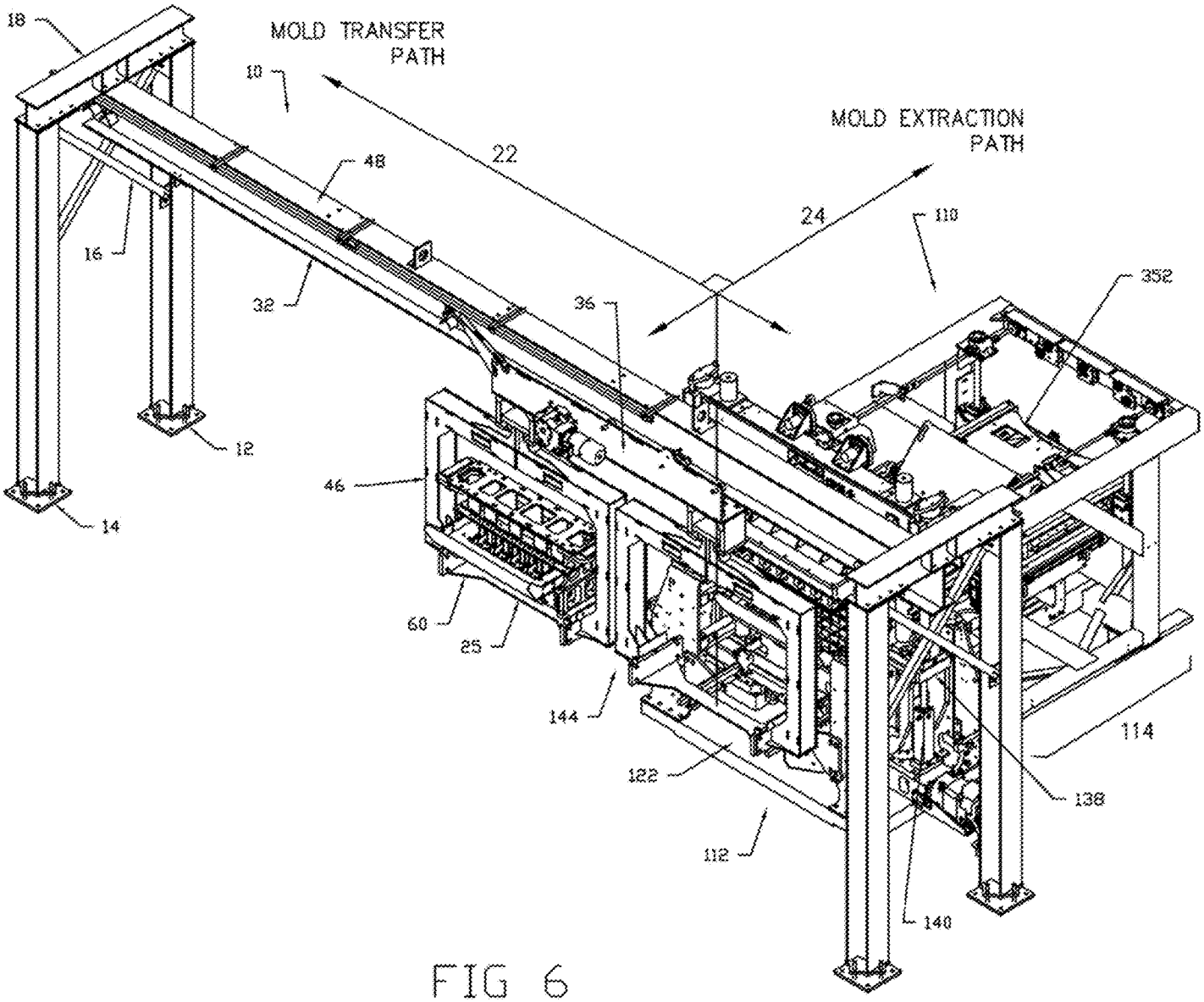
FIG. 6 is a perspective view of the CPM+ of FIG. 1 with the mold transfer structures in a second, mold-exchange position.
Figure 13:
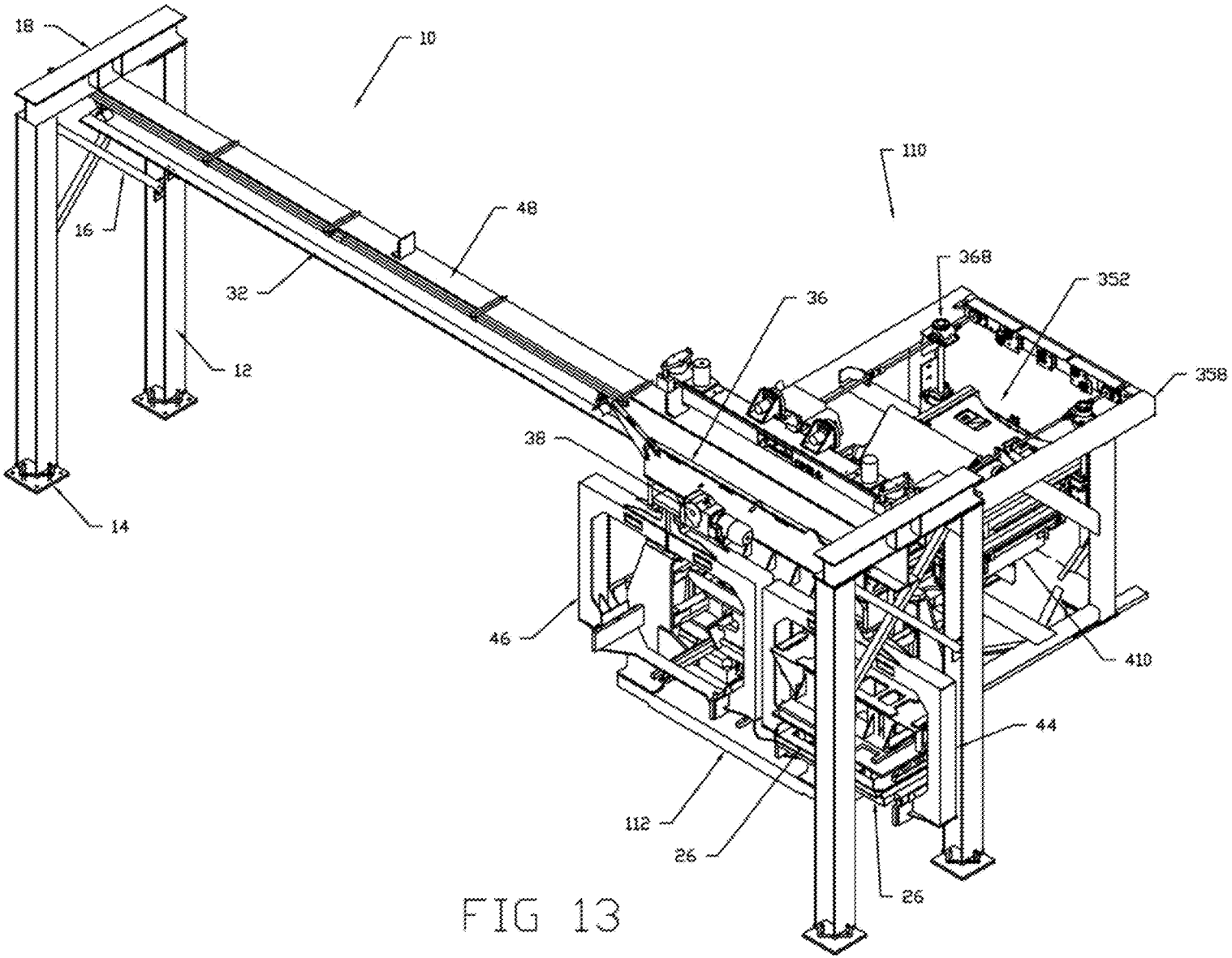
FIG. 13 is a perspective view of the CPM+ of FIG. 1 with the mold transfer structures in a third, mold-exchange position.

FIGS. 1, 6, and 13 illustrate these three main positions of the mold transfer assembly. FIG. 1 shows the home or retracted position where the cassettes 44, 46 are moved away from adjacency with the CPM+ 110 (e.g. all the way to the left). FIG. 6 shows the mold transfer assembly 10 in a first loading position where cassette 44 is aligned with the mold extraction path 24. In this first loading position, mold 26 may be extracted from CPM+ 110 along mold extraction path 24 and placed on cassette 44 for storage. The mold transfer assembly 10 would then move to the second loading position as shown in FIG. 13 where the cassettes 44, 46 are moved to their far right position. Cassette 46 is moved to the position vacated previously by cassette 44 so that the cassette 46 is aligned with the mold extraction path 24. The mold 25 loaded onto cassette 46 is then moved along extraction path 24 by a mold extraction device 410 to a mounted position on CPM+ 110 for production.

The figures show details of the cassette 44 used in mold transfer assembly 10. As shown also in FIG. 7, cassette 44 includes two C-section frames 52, 54 coupled together at the top by a central weldment post 56 on which sits a top plate 58. Cassette frame sections 52, 54 are coupled together at the bottom by a spreader plate 60 that maintains the spacing between the frame sections. Spreader plate is located at the lowest portion of the cassette 44 so as to provide a large central opening 62 within the cassette through which a mold assembly, such as assembly 26 (FIG. 12), may be received.

Coupled on either side of the spreader plate 60 are features configured to guide and retain a mold assembly within the cassette. A pair of shelves 64, 66 are spaced on each side of the spreader plate 60. The shelves are spaced an identical distance apart as the shelves on CPM+ 110 to which the mold assemblies are operatively mounted. The pair of shelves 64, 66 are separated by a central expanse configured to receive the forks of a mold exchange assembly, noting that the spreader plate 60 is located below the top surface of the shelves.

A pair of inwardly sloped guide plates 68, 70 are coupled to outside peripheral sections of the shelves. These plates 68, 70 are angled from a wider top spacing to a narrower bottom spacing and are configured to provide surfaces that guide the mold onto the shelves. Mold alignment dowels 72 are centrally located on a top surface of each of the shelves 64, 66. In use, a mold extraction device would lift mold assembly 26 from the shelves on CPM+ 110 and carry it through the opening 62 of cassette 44. The mold extraction device would then lower the mold assembly 26 onto cassette shelves 64, 66 so that apertures on an underside of the mold assembly receive the dowels 72.

The method for exchanging molds in a concrete products forming machine 110 uses a mold transfer assembly 10 of a type having an overhead track running 20 on a linear path 22. A carriage assembly 36 is mounted to the track and coupled to first and second spaced mold cassette assemblies 44, 46. The method comprises moving the first mold cassette assembly 44 along the linear path to a mold receiving position (FIG. 6) adjacent a concrete products forming machine 110. The first mold 26 is then moved out of a concrete products forming machine 110 along a mold-transfer path 24 perpendicular to the linear path 22 of the first mold cassette assembly 44 to a mold-receiving position. The first mold 26 is then mounted within the first mold cassette assembly 44. After mounting the first mold 26, the first mold cassette assembly 44 is moved along the linear path 22 out of the mold-receiving position. The second mold cassette assembly 46, and pre-mounted second mold 25, are then moved along the linear path 22 to the mold-receiving position (FIG. 13). The second mold 25 is then demounted from the second mold cassette assembly 46 and moved along the mold-transfer path 24 to the concrete products forming machine 110 to effect a mold change within the CPM.

The mold transfer assembly 10 is not limited to two cassette assemblies but can have any number of multiple cassette assemblies and corresponding mold assemblies. Furthermore, it is preferred but not necessary to the teachings of the invention that the cassette assemblies be configured to move along the track while coupled a fixed distance from one another so that the cassette assemblies move in common during movement between the retracted position and the two or more loading positions. Furthermore, it is not necessary that the track be linear or perpendicular to the mold extraction path 416. Instead, it is preferred that the expanse opening 62 be arranged perpendicular to the mold extraction path 416 so as to easily receive the mold assembly 26 along said path.

Figure 2:
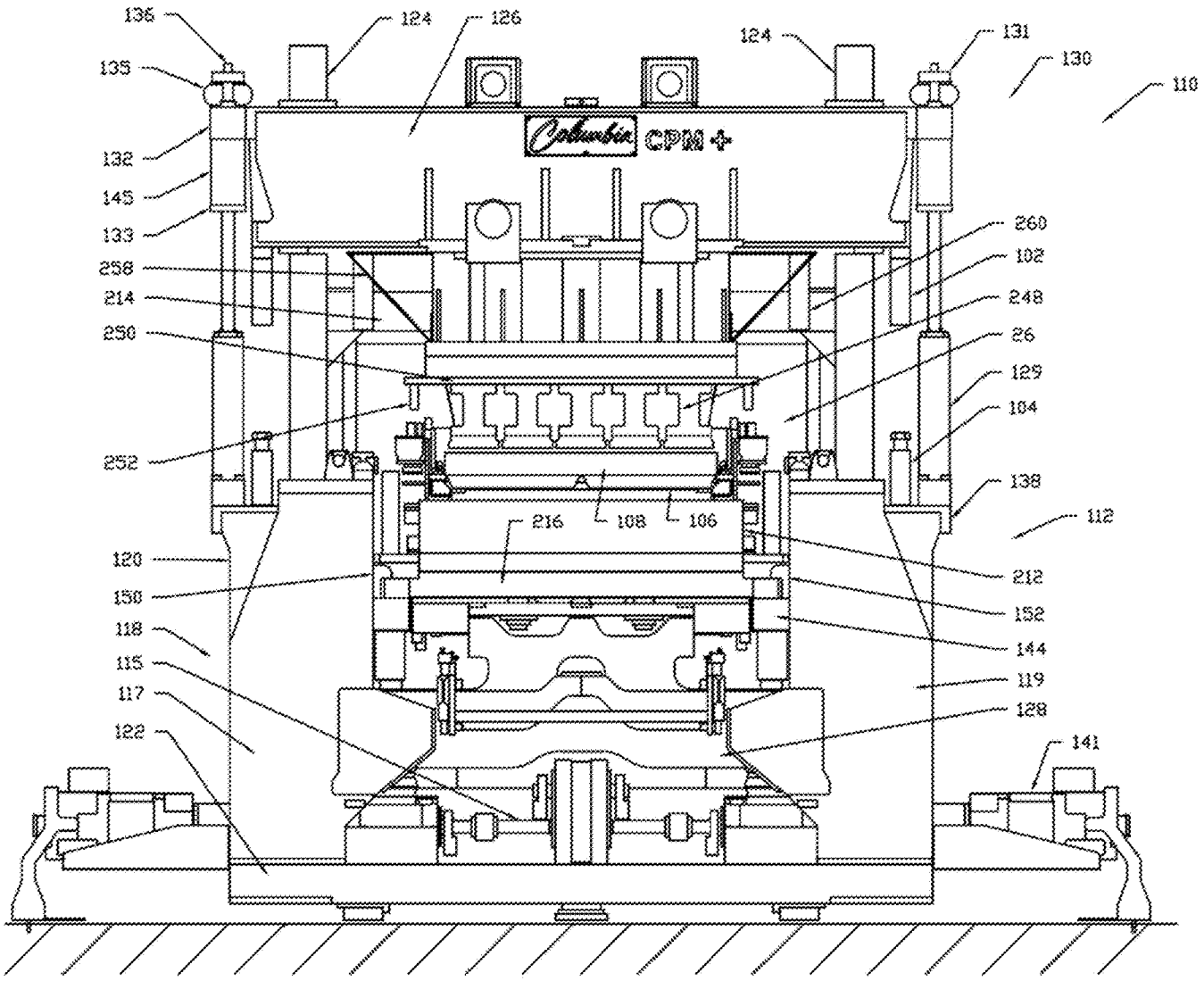
FIG. 2 is front elevation view of the CPM+ of FIG. 1 in a first, raised position during a production cycle of a concrete molded product.
Figure 3:
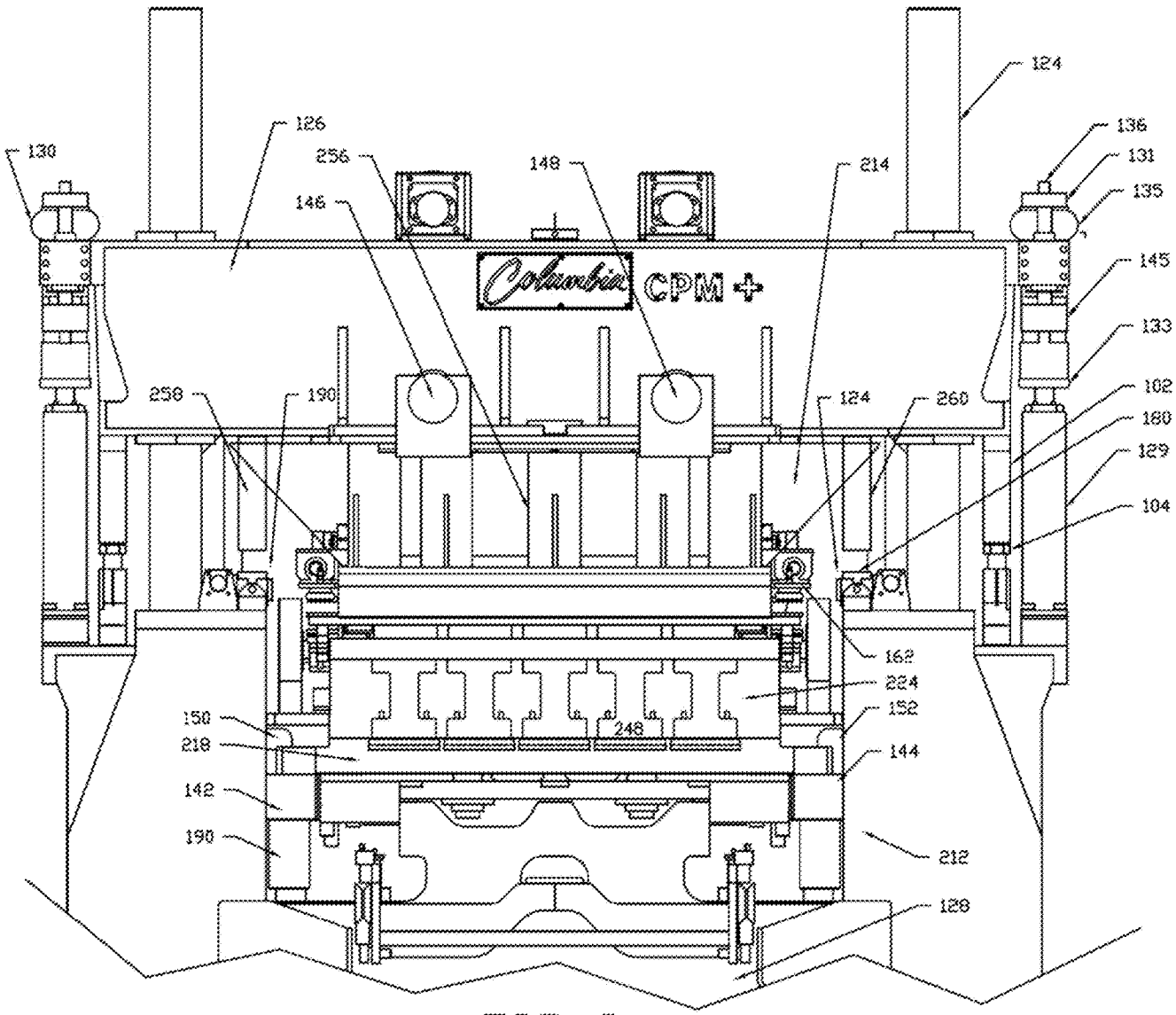
FIG. 3 is a magnified view of the CPM+ of FIG. 2 in a second, lowered position during a production cycle of a concrete molded product.
Figure 12:
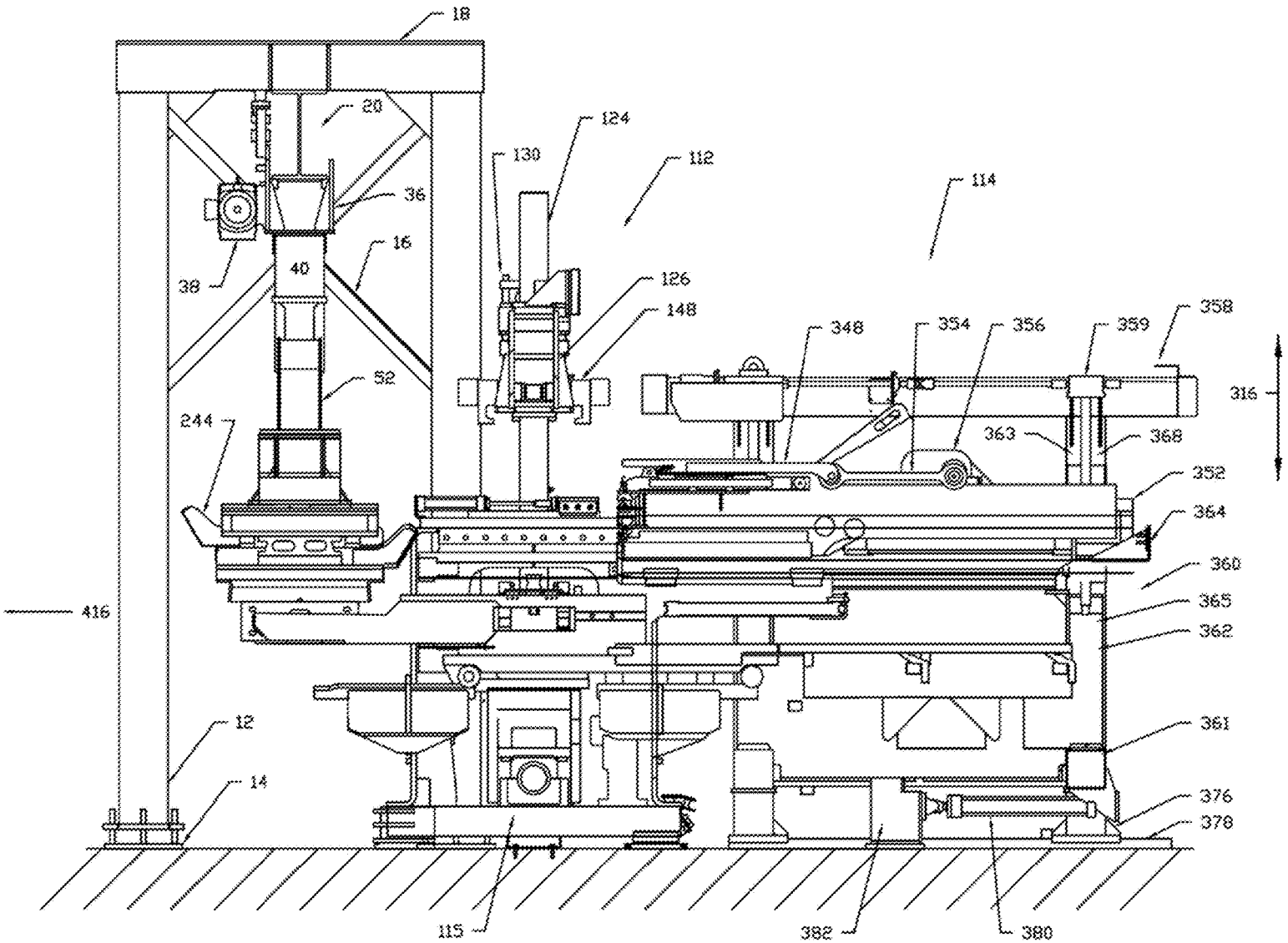
FIG. 12 is a side elevation view of the CPM+ of FIG. 1 showing the mold extractor in a fully extended, lowered position with the mold assembly seated within a first cassette of the mold transfer assembly.

Turning also to FIGS. 2, 3, and 12, a concrete product forming machine (CPM+) 110 is configured according to the present invention, showing a product forming section 112 and a rear-mounted feed drawer assembly 114. The product forming section 112 includes a frame 118 having left and right frame supports, 117 and 119, respectively. Matching front and back frame supports are each joined together at a top end by a guide bar 120 and at a bottom end by a base section 122. A pair of frame supports 117 and 119 are located on each side of the frame 118. A vertically aligned guide shaft 124 is supported at a bottom end by base 122 and slidably coupled to both a compression beam 126 and a stripper beam 128.

It should be noted that the apparatus joined to the compression beam 126 and the stripper beam 128, as is now described, are substantially the same for each side of the product forming section 112 and operate in combination in substantially the same manner.

A compression piston 129 is attached at a top end to an attachment assembly 130. The attachment assembly includes a top plate 131 and a bottom plate 133 joined together by a pair of rods. The rods are slidingly joined to a flange 132 extending laterally from a side of compression beam 126. An air bag 135 is positioned between the top plate 131 and flange 132 and a hard plastic disk 145 is sandwiched between flange 132 and bottom plate 133.

A platform 138 extends across the top of stripper beam 128 and supports the compression piston 129. A stripper piston 140 (FIG. 6) rests on the base 122 of frame 118 and is joined at the top to the underside of platform 138. An electric motor 141 is attached to a vibrator system.

In the product forming section, the compression beam 126 is shown in a raised position and slides vertically along guide shafts 124 with a mold assembly 26 mounted within the concrete products forming machine 110. Mold assembly 26 includes a mold box portion 212 and a head assembly portion 214 that are fitted together in alignment with one another for mounting together onto a concrete products forming machine as described further below. Assemblies 212 and 214 are constructed to form/mold concrete products having a certain size and configuration, whereas different mold boxes can have differently configured assemblies resulting in different products.

Mold box 212 includes a body with a front wall 216 and a back wall 218 joined together with side walls and having cavities, e.g. cavity 224 (FIG. 3), for receiving and molding the concrete products. The side walls each have a side face that spans between a bottom facing surface of the side face and a top facing surface.

The front and back walls of the mold box 212 are sized for extending substantially between a pair of shelves on a concrete product forming machine—e.g. die supports 142 and 144 on CPM+ 110—allowing the mold box 212 to sit directly on top of the shelves.

A production run uses a mold box 212 having cavities 224 for receiving and molding concrete products, a head assembly 214 having multiple shoes 248 aligned within the mold assembly cavities, and compression strip stops 258, 260 located outside the shoes. The mold box 212 is spanned across the pair of shelves 142, 144 on concrete products forming machine 110.

Alignment brackets, e.g. transfer stop brackets 252, can be used to maintain the mold assembly 26 in the aligned condition prior to being mounted in the product forming machine 112. The mold assembly 26 is mounted to the product forming machine 112 by first inserting the holes in the bottom of mold box 212 into the dowels extending upward from shelves 142, 144. Mold box 212 is then fastened to shelves 142, 144 as via computer-controlled clamps 150, 152. Compression beam 126 is then lowered down against the top of head assembly 214.

The head assembly 214 is then coupled to vertically moveable compression beam 126, as via automated clamps 146, 148, and lifted until the shoes 248 are removed from the mold assembly cavities 224 as shown in FIG. 2. The mold box 212 is similarly coupled to the shelves 142, 144 via automated shelf clamps 150, 152 that raise and lower under computer control. A pallet is then lifted against the underside of the mold cavities to prevent material from spilling out the mold box during a filling step. When the mold head assembly 214 is clamped onto the compression beam 126 of the CPM+ machine 110, the compression strip stops 258, 260 are firmly positioned to the underside of the compression beam to allow for rigid transfer of force from the compression beam to the stop blocks of the CPM+ machine.

The head assembly 214, as described above, has downwardly directed shoes 248 that insert into corresponding cavities 224 in mold box 212. The head assembly 214 is attached to the bottom of compression beam 126 and the mold box 212 is mounted on shelves 142, 144 extending laterally from the top of a vibration bracket. Each shelf 142, 144 is joined at the bottom side to shaker shaft 190. Wiper blade 108 and arm 106 are positioned in front of shoes 248 and are attached at opposite ends to a pair of rods 162 that extend through top beams. The feed drawer assembly 114 is shown in a retracted position behind shoes 248 and includes wheels attached at the front end.

A table 192 is attached via a set of air bags to the top center portion of stripper beam 128. A front end of pallet feeder includes an outfeed rack with wheels attached to opposite lateral sides of pallet feeder and run on a rail attached to opposite sides of frame 118.

The attachment assembly 130 is further shown with flange 132 of compression beam 126 extending between upper and lower plates 131 and 130, respectively. An upper height stop 102 is attached to each side of compression beam 126 and a lower height stop 104 is attached to the top of platform 138 of stripper beam 128. The guide shafts 124 slidingly extend through the sides of both compression beam 126 and stripper beam 128 serving as a guide for each beam when moved up and down.

Vibration system 115 includes an upper spring steel plate bolted on opposite ends to front and back frame supports, respectively. The steel plate is bolted in the center to a vibration bracket with a lower spring steel plate also bolted at opposite ends to front and back frame support, and is bolted in the middle to the bottom of a vibration bracket. A vibrator rod extends from a vibrator unit to the bottom of a shelf 142, 144 extending from the top of the vibration bracket. A gearbox rotates a shaft in the opposite direction of a drive shaft with a counter-weight attached to shaft to effect vibrational movement.

Figure 4:
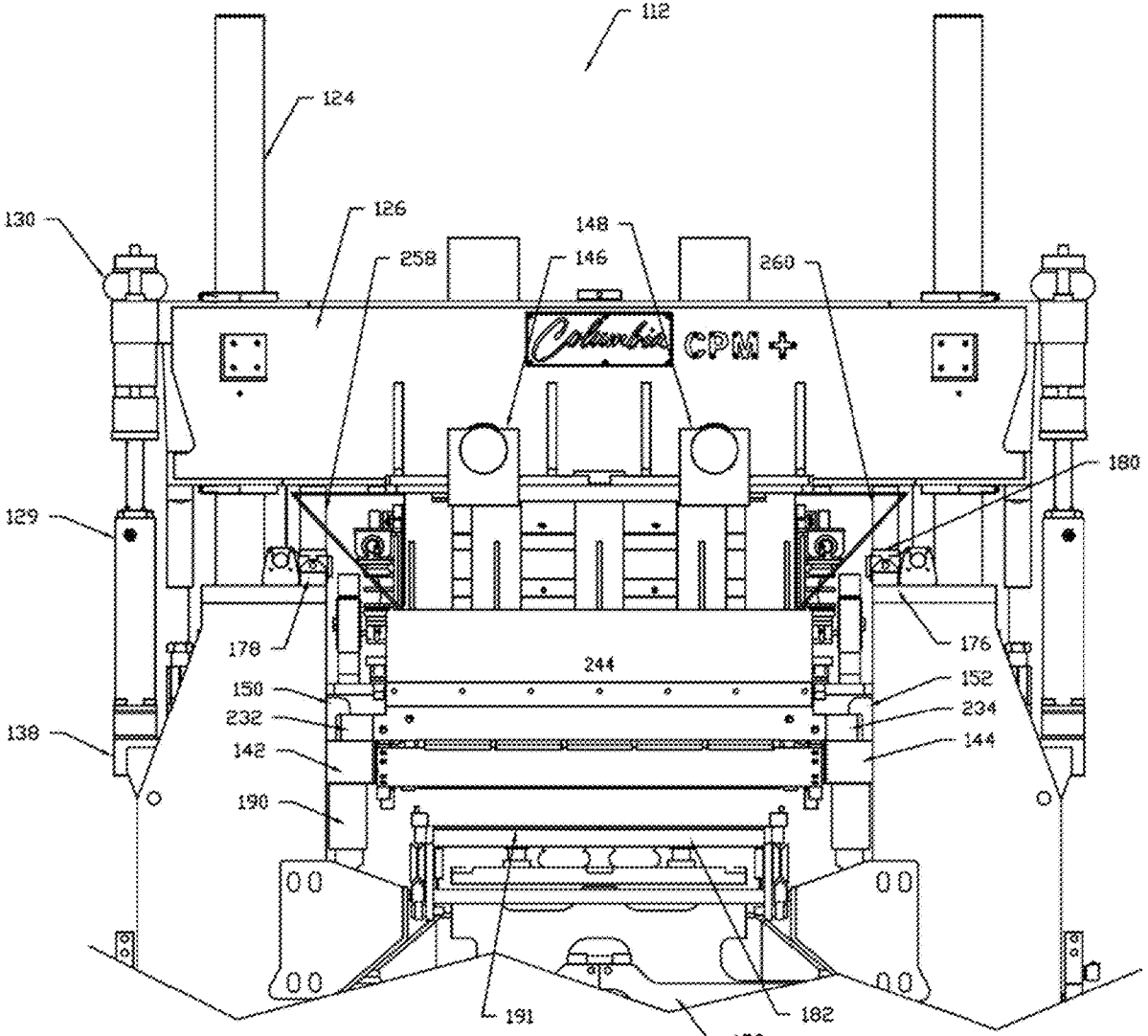
FIG. 4 is a magnified view of the CPM+ of FIG. 2 in a third, lowered position during a production cycle of a concrete molded product.

Mold 26 includes mounting bracket extensions 232, 234 coupled to each side wall of the mold box 212 to extend the width of the mold assembly 26. In use, and as shown in FIGS. 2-4, the front and back walls of the mold box 212 are sized for extending substantially between a pair of shelves on the concrete product forming machine—e.g. shelves 142 and 144 on CPM+ product forming section 112—to thus allow the mold box 212 to sit directly on top of and span between the shelves 142, 144. The mounting bracket extensions 232, 234 can be used to extend narrower mold boxes to mount to various CPM+s, although such features may not be necessary if the bottom facing surfaces of the sidewalls are wide enough to accommodate the die alignment and mold transfer features described further below. The mounting bracket extensions 232, 234 in combination with the side walls thus form the lower mounting surface of the mold assembly onto these shelves 142, 144 of the concrete products forming machine 112.

Formed in an underside of this lower mounting surface are die alignment holes adjacent an outer periphery of the mold box. When a mounting bracket extension 232, 234 is necessary for extending the width of the mold assembly 26, these die alignment holes are formed in each mounting bracket extension and configured to receive a respective alignment dowel extending upward from the shelves 142, 144 of the concrete products forming machine.

Mold transfer locators 240 (FIG. 10) are formed on the lower mounting surface of the mold box 212, inboard of the die alignment holes and shelves of the concrete products forming machine. In one embodiment, the locators are recesses formed in the lower mounting surface that extend to an inner wall of the mold side walls. The locators 240 are configured to locate the mold box 212 onto mold extractor forks 442, 444 when the mold box is lifted off of the alignment dowels by the mold extractor forks during a mold extraction process as described further below. In use, these mold transfer locators 240 receive tapered alignment blocks formed atop the arms of the mold extraction device. The forks of the extraction device are configured to move between the CPM+ shelves 142, 144 and lift upward against the inward portion of the lower mounting surface of the mold assembly, this inward portion being that portion that does not sit directly atop the CPM+ shelves. The tapered alignment blocks 450, 452 are received within the mold transfer locators and the mold box 10 is lifted off of the shelves 142 144 for transport away from the CPM+. A new mold box is then installed on the CPM+ in a reverse process and the production cycle is then restarted to form newly configured molded products.

A pan 244 sits atop mold box 212 and includes a front-mounted, upwardly-inclined pan front. When the head assembly 214 is lifted from the mold box 212, the mold upper openings of the mold cavities are exposed. A feed drawer 352 is then moved over the top of the mold assembly and concrete is dropped into the mold cavities 224. The pan front keeps the concrete from spilling out the front of the mold as the feed drawer is moved over the mold.

The head assembly 214 includes multiple shoes 248 shaped for slidingly inserting through a top side of the mold box 212 and into the mold cavities 224 coupled vertically with a head leg. The shoes 248 compress the concrete products into a molding condition and push the molded concrete products out a bottom side of the mold box. The shoes 248 are then slidingly removable back out the top side allowing the mold box to receive and mold additional concrete products. A top-mounted connector plate 250 couples the head legs and shoes together in registry with the cavities of the mold box.

Downwardly directed transfer stop brackets 252 are affixed on either side of the connector plate 250 width outside of the shoes 248. Stop brackets 252 are configured to respectively contact a top surface of the side walls when the mold assembly 26 is in a fully assembled condition for transport. When assembled in such a condition, the shoes 248 of the head assembly 214 are suspended within the mold cavities 224 at a designated lower height whereby at least a portion of the compression shoes are still retained within the bottom of the cavities so that the shoes are maintained in proper alignment with the cavities during transport.

The mold transfer stops 252 are unique to the CPM+ mold described. They are permanently attached to the mold head assembly 214 but only contact the mold box 212 at time of mold transfer. They provide for holding the mold head assembly vertically and parallel in relationship to the bottom of the mold box as well as positioned accurately to center of mold box during transfer into and out of the CPM+ machine. The mold transfer stops are designed in such a way that they do not come into contact with the mold box during production cycle operation of the machine.

A head spacer 256 is affixed to the connector plate 250 to normalize the vertical height of the entire mold assembly 26. Compression strip stop brackets 258, 260 are downwardly directed from side walls of the head assembly 214 and have a terminating lower surface disposed above and outside of the transfer stop brackets 252. As shown in FIG. 4, the compression stop brackets 258, 260 are configured to contact a respective bumper surface 180 on the concrete products machine prior to the transfer stop brackets 252 contacting the mold box 212 during a molding process. In a preferred implementation, this difference is around approximately ¾" and protects the mold during the repeated process of compressing the head assembly 214 into the mold box 212.

In a preferred construction of the mold assembly 26, the head assembly 214 (and more specifically the head spacer 256) includes slots formed on outside upper surfaces thereof. These slots are located outside the width of the stop brackets 252. The compression strip stop brackets 258, 260 are slidably received in each of the slots to enable tool less insertion and removal of the compression strip stop brackets from the head assembly. In this way, a library of stop brackets 258, 260 can be maintained separately from the mold boxes and the proper sizes inserted during a production run. The compression strip stops are part of parts bin and can be reused in molds having the same product heights. The compression beam on the CPM+ is 33" from the pallet table surface, thus the distance between the bottom of the mounting bracket extension that sits on the die support shelves to the bottom of the compression strip stop is a fixed height. The head spacer 256 has provision for tool-less insertion of the compression strip stops 258, 260, offline, at the staging area of a mold transfer device and are transferred into the machine at the time of the mold assembly transfer. They are capable of being used from one mold to another with the same product height and are not a permanent component to every mold assembly In a preferred implementation, each of the compression strip stop brackets 258, 260 have an upper flared section wider than the head assembly slots so that the lower section inserts through the slot and the upper flared section sits atop the head assembly. Stop brackets 258, 260 are maintained within the slot during a production run when the head assembly is affixed to the compression beam.

FIGS. 2-4 illustrate three successive vertical compressions of the concrete products forming machine 112. FIG. 2 illustrates the compression beam in a fully lifted position so that the head assembly 214 of mold assembly 26 is lifted from engagement with the mold box 212 and the compression pistons 129 raising the compression beam are in the fully extended position. In the step shown in FIG. 3, the compression pistons 129 are retracted until the upper height stops 102 contact the lower height stops 104. At this step, the shoes 248 of the head assembly 214 are positioned at the tops of the mold cavities 224. In the step shown in FIG. 4, the compression beam 126 and the stripper beam 128 are lowered in locking relationship with one another so that the distance between the two is approximately the same until the stop brackets 258, 260 contact the bumper surface 180 on the compression beam stop assemblies 176, 178. With the mold retained in position on shelves 142, 144, the shoes 248 plunge into the mold cavities 224 and press the molded product out onto the pallet table 191 for transport away from the CPM.

More specifically, the compression beam is raised to lift the shoes 248 out from the mold cavities 224 and the cavities 224 of mold box 212 are filled with concrete. As shown in FIG. 3, compression beam 126 is then lowered until the shoes 248 are slidingly inserted into the cavities 224 through a top side of the mold box 212. With the shoes 248 at the top of the mold box cavities and against the top of the concrete, the mold is vibrated by the CPM 26 to remove air pockets from within the molded product and to ensure that the concrete fills the entirety of the mold cavity for more uniform molded concrete products. After this first intermediate lowered position, the compression strip stop brackets 258, 260 are lowered with the stripper beam to a second intermediate lowered position to make contact with stop blocks 176, 180 positioned on the CPM+ above and outside the shelves 142, 144. The lowering step is stopped when bottom surfaces of the compression strip stops 258, 260 contact stop block surfaces on the concrete products forming machine. The stop blocks 176, 180 are preferably topped by a rubber surface adapted to minimize the shock of contact with the stop brackets 258, 260 and of the head assembly 214 with the mold box 212.

After lowering the head assembly to the intermediate lowered position, the head assembly and pallet 191 are lowered together as shown in FIG. 4. The shoes 248 thus continue to compresses the concrete products into a molding condition and pushes the molded concrete products out a bottom side of the mold box until the molded concrete products are fully removed from the cavities and sitting upon the pallet 191. The pallet is then removed and a new one moved into position, the shoes 248 are slidingly removable back out the top side of the mold cavities 224 to the position shown in FIG. 2, and the production cycle continued to allow the mold box to receive and mold additional concrete products.

When the mold assembly 26 is to be removed from the CPM, the rubber blocks of stop blocks 176, 180 are retracted by pneumatic actuation or rotated out of the way of strip stops 258 260 and head assembly 214 lowered by compression beam 126 onto the mold box 212 until the mold transfer stops 252 come into contact with the top of the mold box.

These stop block assemblies 176, 180 are mounted on to the top surface of the concrete products machine main frame center section, one on each side and mirroring the other. Each assembly is comprised of a pneumatic cylinder, a steel bar slider, a rubber block, a steel block mount for the rubber block, a proximity electric switch for position sensing feedback, as well as various mounting brackets and fasteners. The pneumatic cylinder is automatically controlled through pneumatic valving and the PLC control system of the concrete products machine.

Each assembly is set such that its rubber block is directly under the respective strip stop 258, 260 of the mold head assembly 214 during normal machine production operation. The strip stops contact the rubber blocks of the compression beam stop assemblies 176, 180 at each concrete products machine cycle, allowing the mold head assembly to be supported at the end of the compression beam down stroke.

Figure 8:
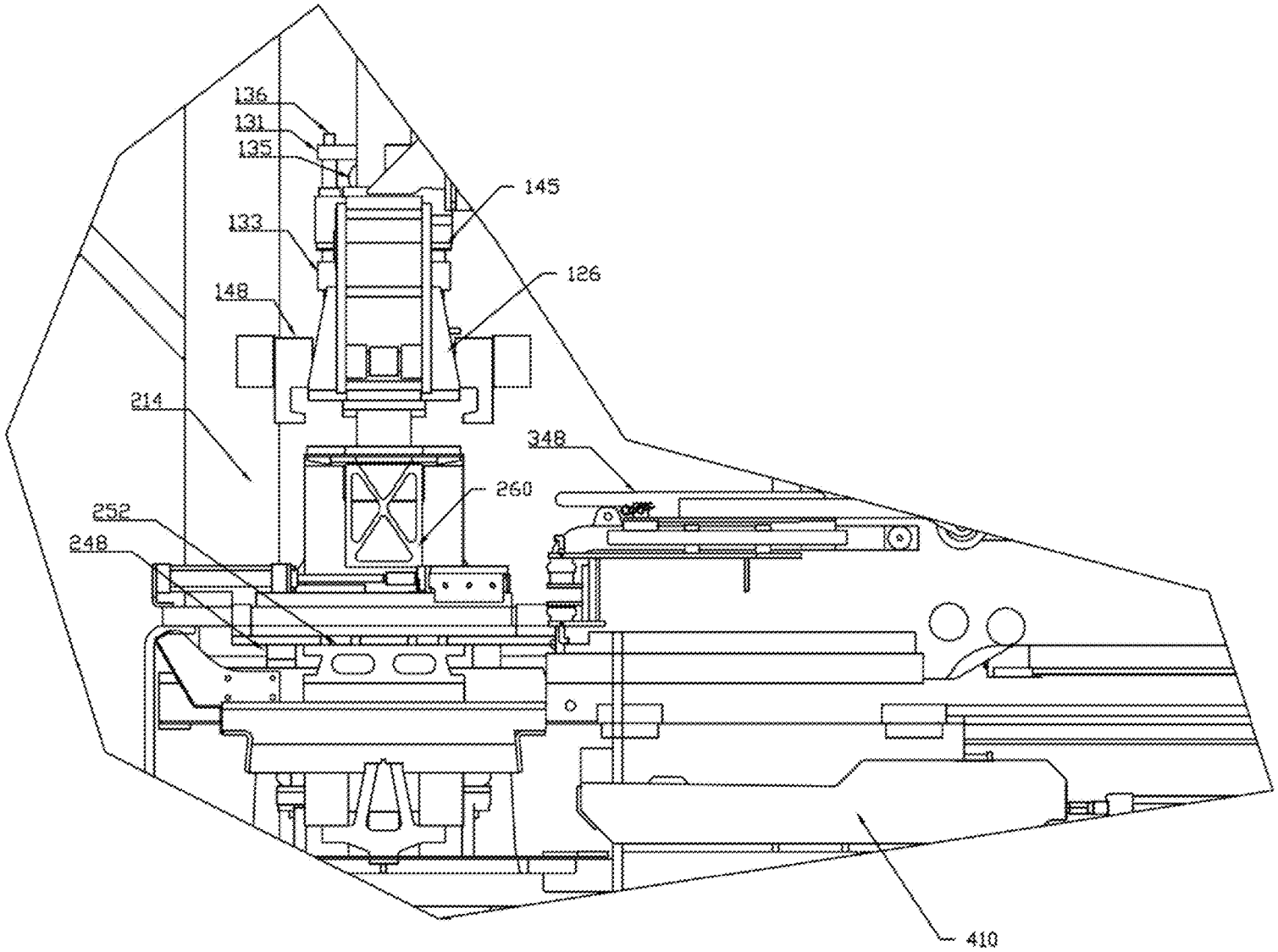
FIG. 8 is magnified side elevation view showing compression beam stop blocks retracted while the compression beam is lowered to set the head assembly on the mold assembly.

When a mold exchange is performed, the stop block surfaces 176, 180 are moved out of the way from contact with the compression strip stops 258, 260. The head assembly 214 is then able to fully lower onto and be supported by the mold box 212 as shown in FIG. 8. The head assembly 214 is then decoupled from the compression beam 102, as by removing clamps 150, 152 and the mold box 212. The head assembly 214 is then lifted from the shelves 142, 144, and from the alignment dowel on the shelves, from below and transferred in a transfer plane outward from the concrete products forming machine (here out from the page).

After the mold exchange process and with a new mold in place, the pneumatic cylinders place the rubber blocks back in position such that they are immediately under the strip stop 258, 260 of the mold head assembly 214 for normal production operation.

Figure 5:
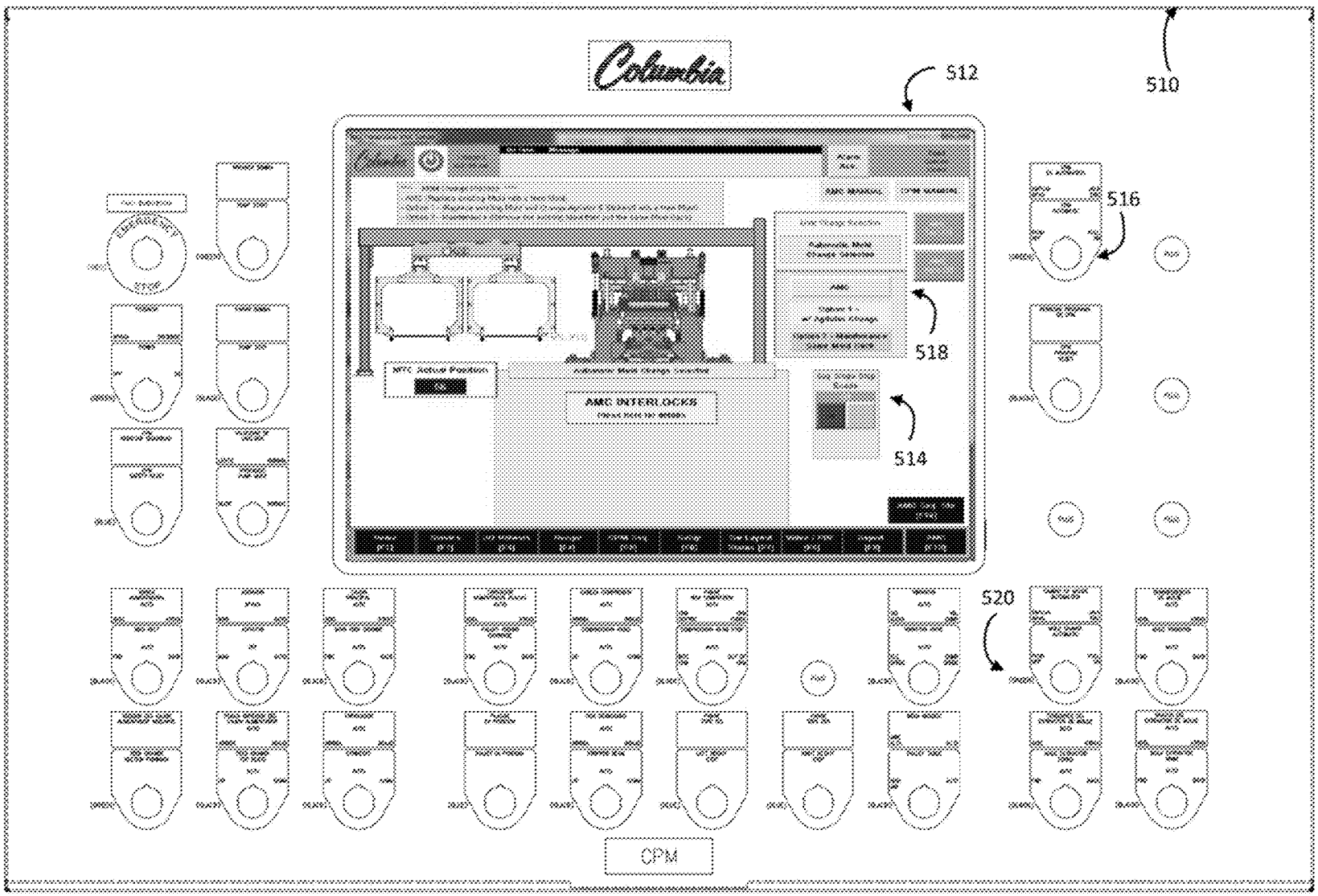
FIG. 5 is a plan view of an operations console with HMI screen for automated control of the CPM+ and mold change system.

FIG. 5 shows a computer and control console 510 used for operating the mold transfer assembly 10, the CPM+ 110, and the feed drawer assembly 114 with integrated mold exchange assembly. The console 510 houses the human machine interface (HMI) screen 512.

To produce product 'A', an operator would go to the HMI home screen and depress the stop button 514. This will stop the machine after finishing a machine cycle and exiting the concrete product last produced. The operator will take the concrete products machine out of automatic by depressing the automatic button 516 on the console.

To form a new product, the operator will select the new product recipe 518 from the HMI screen 512. The product recipes reside in the Command View which is a PC-based supervisory system. The operator will select the next product recipe from the Command View screen and this selection will then be written to the machine PLC and shown on the HMI screen. The operator will go to the automatic mold change (AMC) screen on the HMI 512 and will select AMC, option 1, or option 2 via virtual buttons 518. The AMC is for a mold change only where the agitator and strike off remain the same. In the examples shown, option 1 is where the agitator and strike off need to be changed as well and the automatic cycle is different, and option 2 is if the operator simply wants to remove the mold assembly for maintenance or cleaning of the machine and then put the same mold back into the machine.

The operator will pull the AMC auto button 520 out on the console and the mold change will commence. Once completed, the operator will depress the AMC auto button 520 to take the AMC out of automatic. The operator will then pull the CPM+ auto button 516 out to place the concrete products machine into automatic mode.

On the HMI home screen 512, the operator will depress the resume button 514 and the concrete products machine will start production of product 'B'. Virtual button 514 toggles between stop and resume upon successive selections, as via touch sensitive controls.

Figure 7:
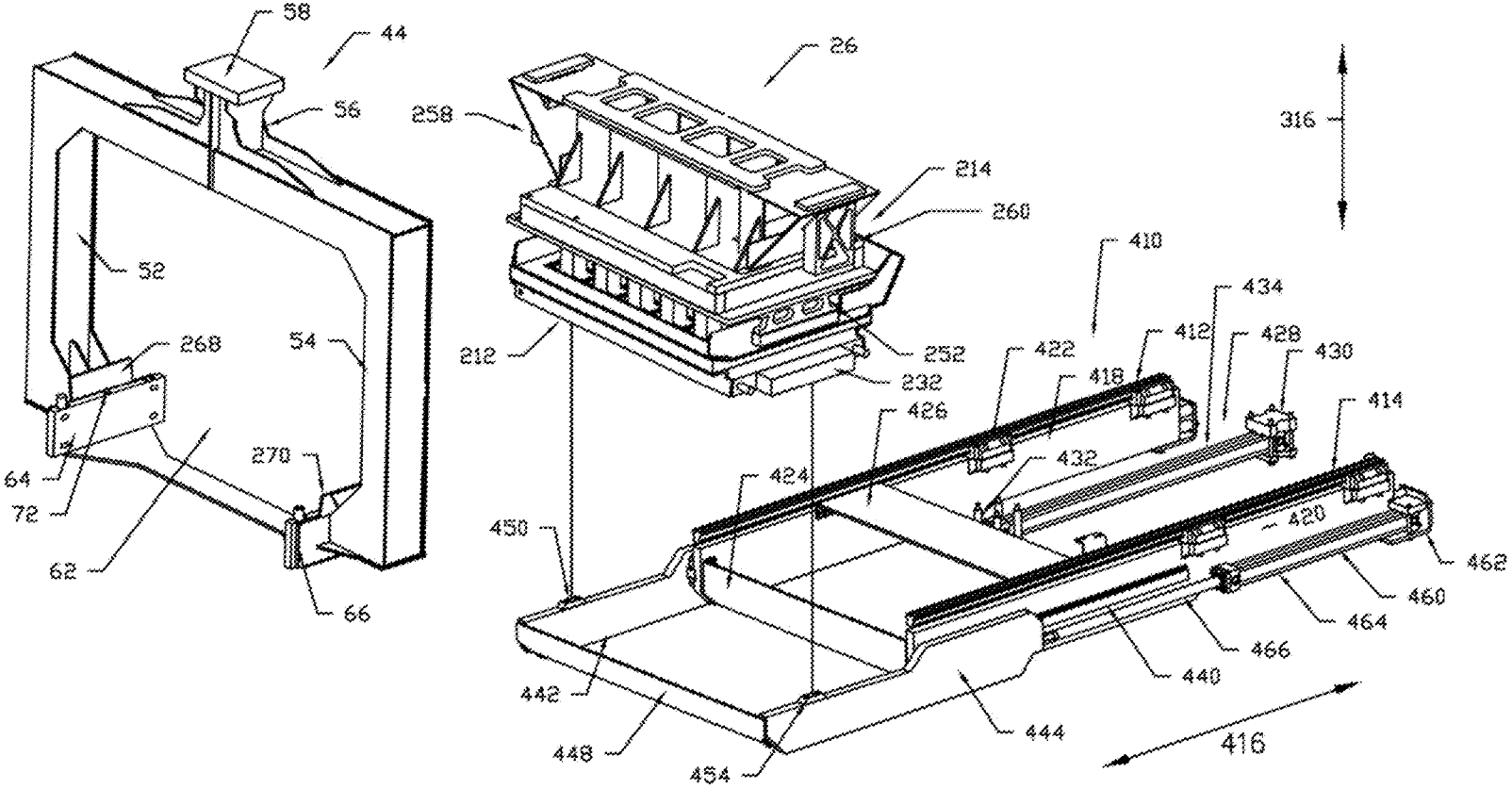
FIG. 7 is a perspective view of a mold extractor assembly of the present invention in a first extended position relative to a mold box assembly and mold cassette assembly.

FIG. 7 shows a mold extraction assembly 410 in combination with a mold assembly 26 and mold cassette assembly 10. Extraction assembly 410 includes a set of inner guide rails 412, 414 coupled along their length to a top plate assembly of the feed drawer section 114 of a concrete products forming machine (FIGS. 8-12). Guide rails 412, 414 extend parallel to a mold extraction path 416 and include grooves running longitudinally along the length of the rails on opposed sides. A pair of mold extraction arms 418, 420 are disposed just underneath the inner guide rails 412, 414 and are slidingly connected thereto via sets of guide blocks, such as extraction arm guide block 422, that are affixed to upper ends of the arms 418, 420 and slide within the grooves formed in the sides of the guide rails.

Extraction arms 418, 420 are coupled together via a front bracing plate 424 and a rearwardly disposed cross-bracing plate 426 running between top ends of the arms. A hydraulic cylinder 428 is positioned along a central axis of the extraction assembly 410 and includes a cylinder mount block 430 at a rear end and a cylinder support block 432 at a front end mounted upward to the top plate assembly of the feed drawer section of the concrete products forming machine. A cylinder housing 434 is fixedly coupled between the mount block 430 and support block 432 and receives a hydraulic piston 436. A terminal end of the hydraulic piston 436 is coupled to an underside of the cross-bracing plate 426 spanning between extraction arms 418, 420. Actuation of the hydraulic cylinder 428 causes the piston 436 to extend out of the end of the housing 434 and push the plate 426, thereby causing the connected arms 418, 420 to slide forwardly along the inner guide rails 412, 414 to an extended position. Likewise, the hydraulic piston 436 may be retracted into the housing 434 and withdraw the arms 412, 414 to a retracted position as shown in FIG. 8.

Mold extraction assembly 410 further includes a set of outer guide rails 438, 440, with each affixed to outside walls of respective extraction arms 418, 420 and extending parallel to the inner guide rails 412, 414 and mold extraction path 416. A pair of mold extraction forks 442, 444 are telescopically nested about the arm assembly and slidingly coupled to respective arms 418, 420 via a set of guide blocks, such as extraction fork guide block 446, that allow the forks to move slidingly along the length of the rails 438, 440 and extend the forward reach of the mold extraction assembly 410. Forks 442, 444 are coupled together at a front end by a spreader plate 448. Each of the forks includes a tapered alignment block, such as blocks 450, 452, that extend upward from a top surface of the forks and mate (see broken lines) with complementary apertures formed on the underside of a mold assembly 26. The tapering narrows to the upper surface of the alignment blocks 450, 452, preferably in the direction of extraction 416 so as to accommodate for tolerances with positioning the forks in relation to the mold assembly 26 as described further below. More preferably, the tapered surface has a principal taper in a direction parallel with the outside track, and a minor taper in a horizontally orthogonal direction to that track. Forks 42, 44 are profiled with an angled surface 54 coupling the thicker rear end with the narrower front end to optimize section stiffness and weight.

Horizontal movement of the arm assembly is implemented by a pair of hydraulic cylinders 458, 460 coupled via a bracket (e.g. bracket 462) affixed to a back end of respective extraction arms 418, 420. Cylinders each include a cylinder housing 464 fixedly coupled to bracket 462 and a hydraulic piston 466 received in the housing and extending parallel to the extraction path 416. A terminal end of the hydraulic piston 466 is coupled to a rear end of a respective fork 444. Actuation of the hydraulic cylinders 460 causes the piston 466 to extend out of the end of the housing 464 and push the fork 444, thereby causing the fork assembly to slide forwardly along the outer guide rails 438, 440 to an extended position. Likewise, the hydraulic piston 466 may be retracted into the housing 464 and withdraw the forks 442, 444 to a retracted position as shown in FIG. 8.

Figure 9:
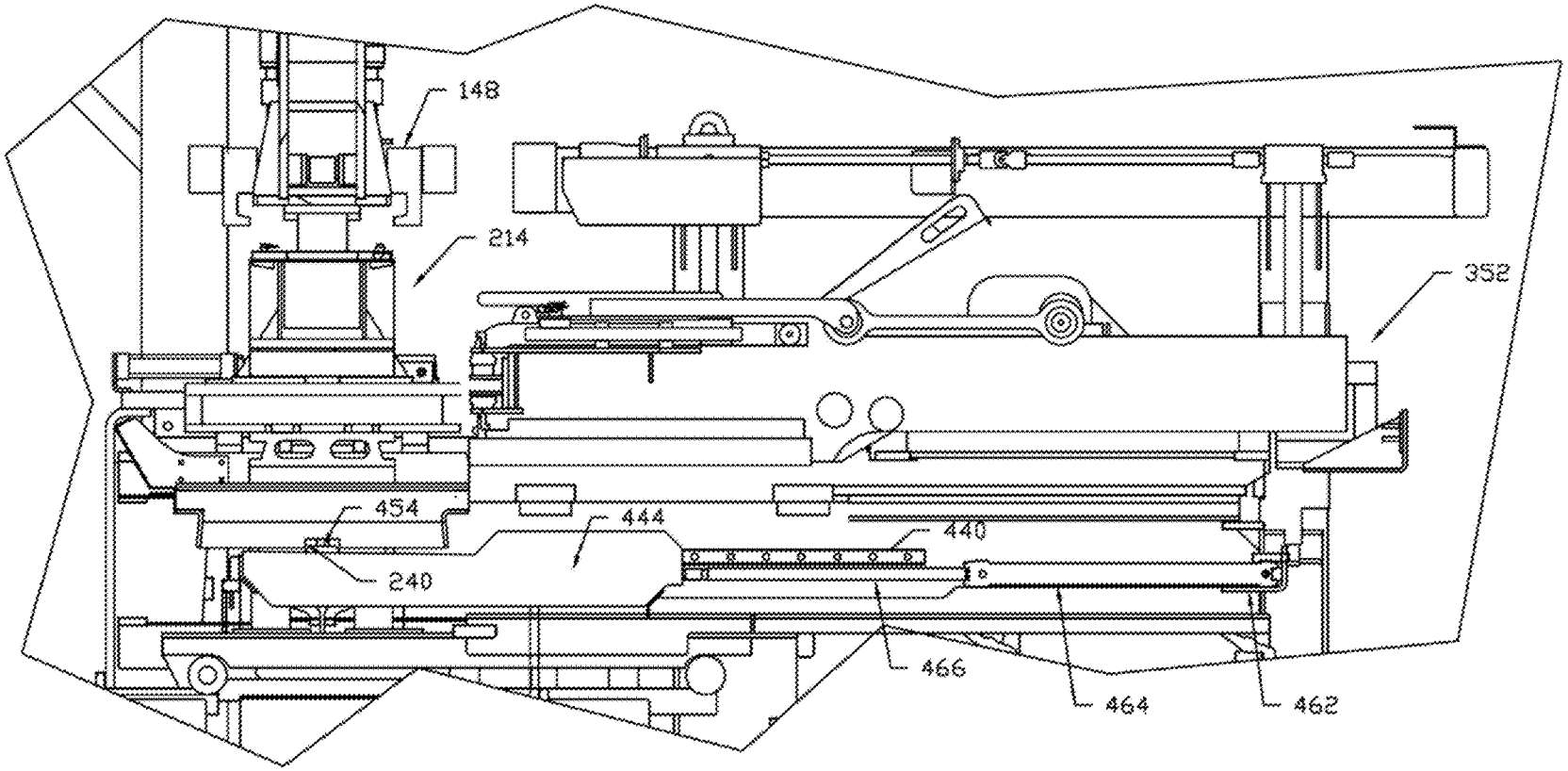
FIG. 9 is a side elevation view of the CPM+ of FIG. 1 showing the mold extractor in a partially extended, lowered position.
Figure 10:
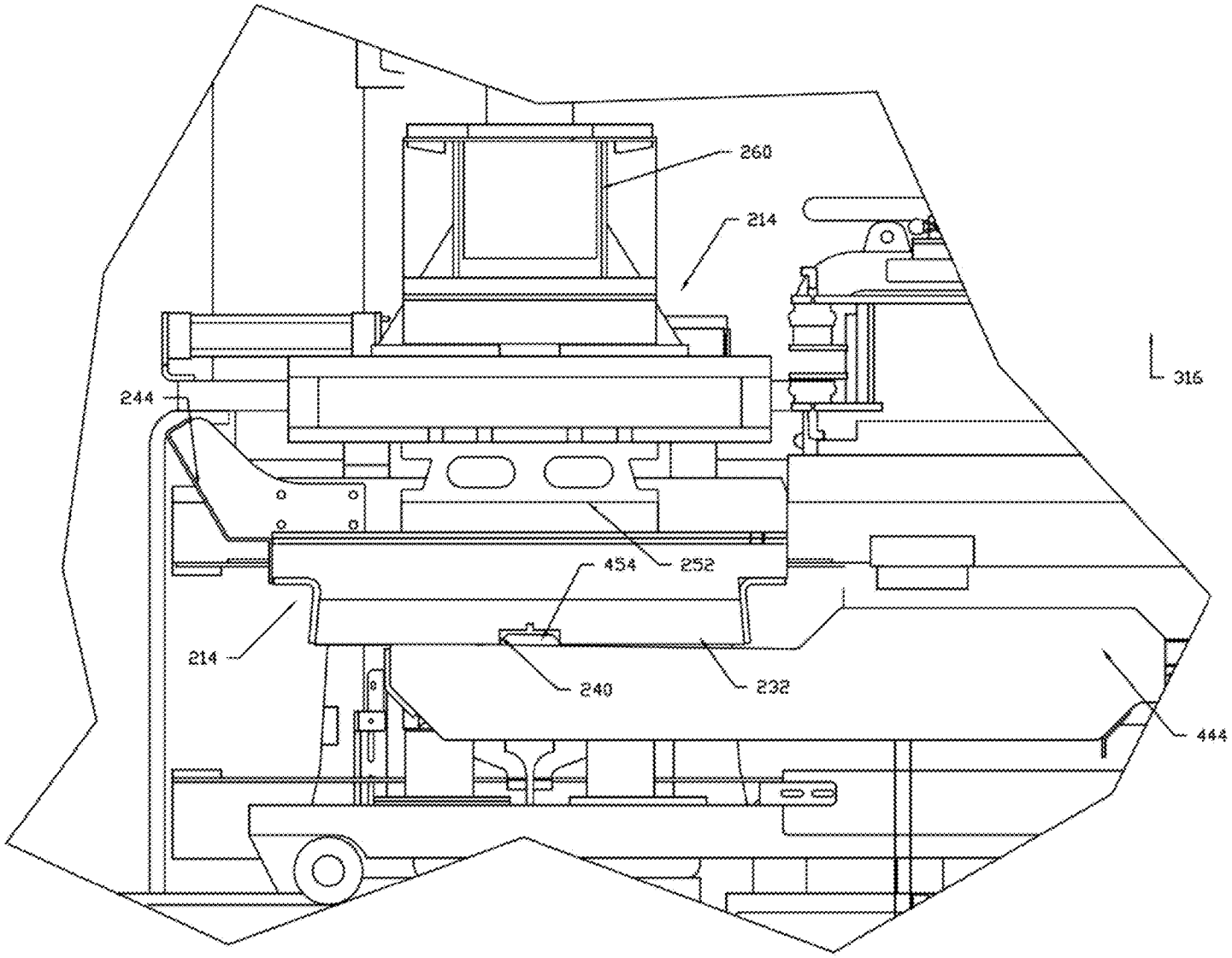
FIG. 10 is a side elevation view of the CPM+ of FIG. 1 showing the mold extractor in a partially extended, lifting position.
Figure 11:
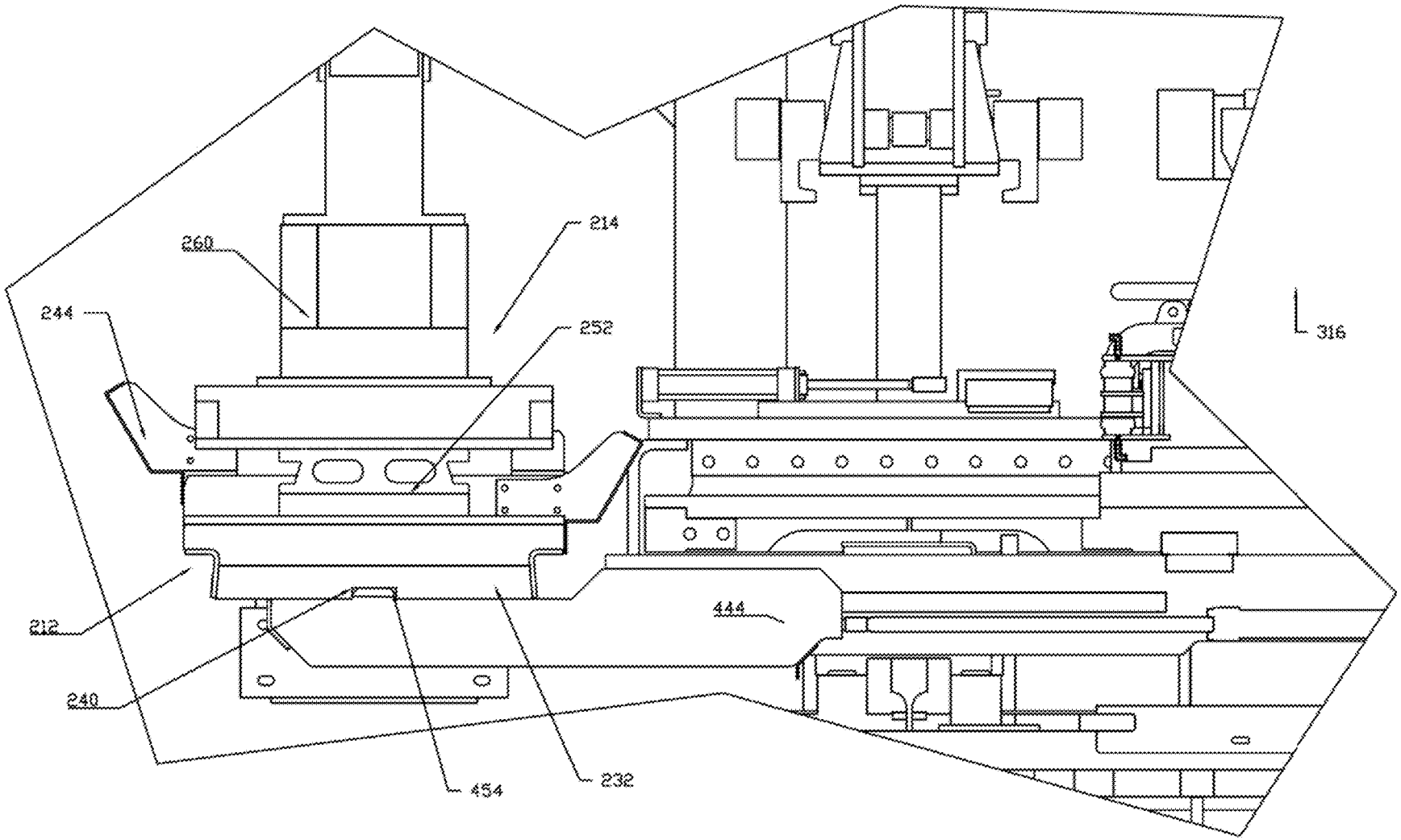
FIG. 11 is a side elevation view of the CPM+ of FIG. 1 showing the mold extractor in a fully extended, lifting position.

Vertical movement 456 of the mold extraction assembly 410 via means described further below act to approach and lift the mold assembly 26 from below so it can be placed on either the concrete products machine shelves 142, 144 or the cassette assembly shelves 64, 66 during a mold exchange process. Retraction and extension of the mold extraction assembly occurs in three phases: (1) the fully retracted position is shown in FIG. 8; (2) the partially extended position is shown in FIGS. 7, 9, and 10 so that the forks 442, 444 are positioned below mold assembly 26 mounted on a CPM+; and (3) the fully extended position as shown in FIGS. 11-12 where both the forks and the arms are extended along respective rails/tracks 438, 440, 412, 414. In combination with vertical movement of the mold extraction assembly 410 as part of the vertical positioning of feed box drawer 352, the mold extraction position has a total of five operative positions including (a) fully retracted [FIG. 8], (b) partially extended and lowered [FIG. 9], (c) partially extended and raised [FIG. 10], (d) fully extended and raised [FIG. 11], and (e) fully extended and lowered [FIG. 12].

The mold assembly 26 includes a mold box portion 212 and a head assembly portion 214 that are fitted together in alignment with one another for mounting together onto a concrete products forming machine as described further below. Assemblies 212 and 214 are constructed to form mold concrete products having a certain size and configuration, whereas different mold assemblies can have differently configured assemblies resulting in different products. As the exchange of one mold assembly with another on a concrete products forming machine typically requires a large amount of manual labor and downtime, enabling an automated exchange of one mold assembly with another using the extraction assembly described herein is a key goal of the invention.

Generally, mold box 112 includes a body with a front wall and a back wall joined together with side walls and having cavities for receiving and molding the concrete products. The side walls each have a side face that spans between a bottom facing surface of the side face and a top facing surface.

A mounting bracket extension 232 is coupled to each side wall of the mold box 212 to extend the width of the mold assembly 26. In use, the front and back walls of the mold box 212 are sized for extending substantially between a pair of shelves 142, 144 (FIG. 3)—also referred to as die supports—on a concrete product forming machine to thus allow the mold box 26 to sit directly on top of and span between the shelves. The mounting bracket extensions 232 can be used to extend narrower mold boxes to mount to various CPMs, although such features may not be necessary if the bottom facing surfaces of the sidewalls are wide enough to accommodate the die alignment and mold transfer features described further below. The mounting bracket extensions 232 in combination with the side walls thus form the lower mounting surface of the mold assembly onto these shelves 142, 144 of the concrete products forming machine.

Formed in an underside of this lower mounting surface are die alignment holes adjacent an outer periphery of the mold box. When a mounting bracket extension 232 is necessary for extending the width of the mold assembly 26, these die alignment holes are formed in each mounting bracket extension and configured to receive a respective alignment dowel extending upward from the shelves of the concrete products forming machine.

Mold transfer locators are formed on the lower mounting surface of the mold box 212, inboard of the die alignment holes and shelves of the concrete products forming machine. In one embodiment, locators are recesses formed in the lower mounting surface that extend to an inner wall of the mold side walls. Locators are configured to precisely locate the mold box onto mold extractor forks 442, 444 when the mold box is lifted off of the alignment dowels by the mold extractor forks during a mold extraction process as described further below. In use, these mold transfer locators receive the tapered alignment blocks 450, 452 formed atop the forks 442, 444 of the mold extraction device 410. The forks 442, 444 of the extraction device 410 are configured to move between the CPM+ shelves 142, 144 and lift upward against the inward portion of the lower mounting surface of the mold assembly, this inward portion being that portion that does not sit directly atop the CPM+ shelves. The tapered alignment blocks are received within the mold transfer locators, and the mold assembly 26 is lifted off of the shelves 142, 144 for transport away from the CPM+. A new mold box is then installed on the CPM+ in a reverse process and the production cycle is then restarted to form newly configured molded products.

FIG. 7 shows details of the cassette 44 used in mold transfer assembly. Cassette 44 includes two C-section frames 52, 54 coupled together at the top by a central weldment post 56 on which sits a top plate 58. Cassette frame sections 52, 54 are coupled together at the bottom by a spreader plate 60 that maintains the spacing between the frame sections. Spreader plate is located at the lowest portion of the cassette 44 so as to provide a large central opening 62 within the cassette through which a mold assembly, such as assembly 26, may be received.

Coupled on either side of the spreader plate 60 are features configured to guide and retain a mold assembly within the cassette. A pair of shelves 64, 66 are spaced on each side of the spreader plate 60. The shelves are spaced an identical distance apart as the shelves 142, 144 on the CPM to which the mold assemblies are operatively mounted. The pair of shelves 64, 66 are separated by a central expanse configured to receive the forks 442, 444 of a mold exchange assembly, noting that the spreader plate 60 is located below the bottom surface of the shelves. The height of the vertical expanse—and in this case the height of shelves 64, 66—is large enough so as to accommodate the height of a front end of the mold extractor forks 442, 444 and prevent collision with the spreader plate 60 when the forks have set the mold assembly 26 onto the top surface of shelves 64, 66 and is then withdrawn back to a retracted position.

A pair of inwardly sloped guide plates 68, 70 are coupled to outside peripheral sections of the shelves. These plates 68, 70 are angled from a wider top spacing to a narrower bottom spacing and are configured to provide surfaces that guide the mold onto the shelves. Mold alignment dowels 72 are centrally located on a top surface of each of the shelves 64, 66. In use, the mold extraction device 410 would lift mold assembly 26 from the shelves 142, 144 on the CPM+ and carry it through the opening 62 of cassette 44. The mold extraction device would then lower the mold assembly 26 onto cassette shelves 64, 66 so that apertures on an underside of the mold assembly receive dowels 72.

FIGS. 8-12 illustrate the steps for moving a mold assembly 26 from within a mounted position on a CPM+ 110 to a mold transfer cassette 44.

Turning to FIG. 8, the feed drawer assembly 114 includes a feed drawer 352 joined at a front and back end to wheels 344. The back wheels 344 ride on rail 346 allowing the feed drawer assembly 114 to move back and forth. A motor 356 is joined via a rotator arm 354 to agitator linkage 348.

The feed drawer assembly 114 is supported above the ground by a support frame 358 including four vertically aligned legs 360 each coupled at a top end to an opposite corner of a platform 364 and joined at a bottom end to a bottom beam 361. A series of hollow top beams 359 are attached on the top of platform 364. Four jack screws 368 are each joined at a top end to support frame 358 and joined at a bottom end to platform 364. Each jack screw is connected through a drive linkage and driven by 2 hydraulic motors to raise and lower the feed drawer and attached extraction assembly 410 in direction 316 under control of the CPM+ control system operating on console 510.

The bottom beam 361 is slidingly mounted on top of a rail 378 by guides 376. A piston 380 is mounted to the floor at a front end via mount 382 and joined at a back end to the support frame 358. Piston 380 moves the feed drawer assembly 114, conveyer 416, and support frame 358 back and forth for maintenance.

When the compression beam 126 and stripper beam 128 are in fully raised positions as shown in FIG. 2, head assembly 214 is lifted sufficiently upward so that feed drawer 352 can be moved under shoes 248. Wire brushes are attached to the top of feed drawer 352 and rub the bottom of shoes 248 when moved into the forward position. In the raised stripper beam position, the table 192 lifts the pallet 191 from the pallet feeder and presses the pallet against the bottom side of mold box 212.

FIG. 8 further shows a side view of the mold extraction assembly 410 coupled to a mounting plate 364 affixed to the underside of the feed drawer 352 of assembly 114. Vertical movement 316 of the feed drawer 352 and coupled mold extraction assembly 410 is implemented via a set of screw lifts, implemented by the jack screws 368 driven by linkage and motor as described above. The mold extraction assembly 410, when in a fully retracted position as shown in FIG. 4, fits within the envelope of the feed drawer assembly 114 and uses the preexisting vertical lift system to raise and lower, particularly the forks 42, 44 of the assembly into contact with an underside of the mold assembly 110 as described further below with reference of FIGS. 9 and 10. The mold assembly 110 is then lifted and carried forward along extraction route 16 to the cassette assembly 210 whereupon the mold is set down onto the cassette shelves 264, 266 and onto alignment dowels 272 for storage as shown in FIGS. 11 and 12.

In a first step, the extraction assembly 410 is moved in cooperation with vertical movement 316 of the feed drawer assembly 310 from a raised, retracted position to a lowered, retracted position as shown in FIG. 8. In this position, the mold extraction assembly 410 is located below and rearward (e.g. to the right in FIG. 8) of a mold assembly 26 when said mold assembly 26 is mounted on mold assembly mounts 142, 144 within the concrete products forming machine.

In a next step, and as shown in FIG. 9, the extraction assembly is extended forwardly in a horizontal plane to a partially extended, lowered position beneath the mold assembly. The mold extraction forks 442, 444 are pushed forward 416 via hydraulic cylinders 458, 460 to an extended position so that the mold alignment block structures 450, 452 on the tops of the forks 442, 444 are aligned with complementary structures (e.g. mold transfer locators 240) formed on the underside of mold assembly 26.

In a next step, and as shown in FIG. 10, the extraction assembly 410 is raised into contact with an underside of the mold assembly 26 to a partially extended, partially raised position until the mold assembly 26 is lifted from the mold assembly mounts 142, 144. In this step, the feed box lifting structure raises 316 the feed box and attached mold extraction assembly 410. The alignment blocks 450, 452 are then received within the complementary structures 240 on the mold assembly 26 and the mold is lifted off of the CPM+ shelves 142, 144.

In a next step, and as shown in FIG. 11, the extraction assembly 410 with mounted mold assembly 26 is further extended forwardly 416 in a horizontal plane to a fully extended, partially raised position to a mold transfer assembly, such as cassette 44, arranged perpendicular to a direction of forward movement 416 of the extraction assembly. With the extraction forks 442, 444 having been previously extended, the mold extraction arms 418, 420 are pushed forward 74 via hydraulic cylinder 428 to an extended position so that—in combination with the mold extraction forks 442, 444 also having been fully extended—the mold alignment block structures 50, 52 are aligned within the opening 62 of the cassette assembly 44 and spaced above its shelves 64, 66.

In a final mold extraction step, and as shown in FIG. 12, the extraction assembly 410 is lowered until the mold assembly 26 rests on a first position within the mold transfer assembly. That is, from the position shown in FIG. 11, the feed box lifting structure lowers 316 the feed box 344 and attached mold extraction assembly 410 to thus set the mold assembly 26 onto the shelves 64, 66 of the cassette assembly 44. More specifically, the mold assembly is lowered so that alignment dowels 62 located on a top surface of the shelves are received within complementary apertures formed on the lower surface of the mold assembly 26, outboard of the structures for receiving the alignment blocks on the forks. With the mold assembly 26 now mounted on the cassette assembly 44, the extraction assembly is retracted to the intermediary position shown in FIG. 9. Retraction of the extraction assembly forks 442, 444 is preferably just enough to move the forks out of the way of a mold transfer assembly that moves a new cassette 46 and mold assembly 25 into place for transfer to the concrete products machine 110. In this way, it is preferred that the forks retract to the intermediary position shown in FIG. 9 rather than the fully retracted position as shown in FIG. 8 so as to save time.

After the mold assembly 26 is placed on cassette 44, the mold exchange process operates the motor 38 of mold transfer assembly 10 to move the carriage assembly 36 to a second load-unload position as shown in FIG. 13. The cassette 46 is adjacent this load-unload position and intersects the mold extraction path along which mold assembly 26 was removed. Mold 25 is then removed from cassette 46 in a reverse process to that described above in that (1) the mold extraction forks 442, 444 and arms 418, 420 are fully extended to position the alignment blocks 450, 452 beneath the mold transfer locators 240 formed within the lower surface of mold assembly 25, (2) the mold extraction assembly 410 is then raised by the feed box lifting mechanism so that the alignment blocks 450, 452 engage with the mold transfer locators 240 to lift the mold assembly 25 off of the shelves of cassette 46. The mold extraction arms 418, 420 are then (3) retracted to thus position the mold assembly 25 directly over the shelves 142, 144 of the CPM+ and the extraction assembly (4) lowered to rest the mold assembly 25 on the shelves with a mold alignment dowel received within the complementary aperture formed at a periphery of a lower surface of the mold assembly. The extraction assembly is then (5) fully retracted to within the envelope of feed box assembly 114 and a production cycle begins as described above.

The production plants that use such equipment are relatively dusty, dirty, and noisy environments while at the same time utilize sophisticated equipment. It is generally known in the concrete products industry that it is difficult to find qualified plant operators and difficult to retain qualified plant operators who are willing to work in these environments. This has driven the need for equipment controls that are easy to understand and equipment that is easy to operate. The described concrete products machine delivers a level of automated controls and intuitive operator interfaces to minimize the skill levels of machine operators to successfully operate this equipment.

A key feature of the CPM+ machine design is an automated mold change with product height change which can be accomplished in a very short period of time. Applicants have demonstrated a 'product-to-product' change with product height change in 3 minutes and 20 seconds time. The term 'product-to-product' is an important element in this disclosure and the addition of a product height change is an important element as well.

The mold change sequence is as follows:

- While the concrete products machine is in automatic mode making product 'A', a mold assembly 25 for product 'B' is moved by forklift and placed in the mold transfer cassette 46.
- Machine operator confirms new mold parameters for product mold 'B' on HMI screen prior 512 to the automated mold change process.
- Machine is taken out of automatic mode.
- Automated mold change process begins by pulling the auto start button on the operator control console.
- Compression beam 126 raises off the compression beam stop blocks 176, 178.
- Compression beam stop blocks 176, 178 retract out of the way.
- Compression beam 236 lowers to set the mold head assembly 214 on the mold assembly 212.
- Concurrently, the feed drawer assembly 114 lowers allowing the mold extractor assembly 410 to clear the bottom of the mold assembly 26.
- The fork frame 442, 444 of the extractor assembly 410 extends forward once it is clear of the bottom of the mold assembly 26 to a position to lift the mold assembly off the die supports 142, 144.
- Concurrently, the mold assembly clamps 150, 152 retract.

Concurrently the mold head assembly clamps 146, 148 retract.

The compression beam 126 raises to a position allowing the raising of the mold assembly without interference.

The feed drawer assembly raises causing the fork frame 442, 444 of the extractor assembly 410 to raise the mold box 212 and mold head assembly 214 up and off the die supports 142, 144.

Once the mold assembly 26 is raised high enough to clear the alignment dowels, the extractor aims 418, 420 extend forward removing the mold assembly and head assembly from the machine.

Concurrently with the above, the mold transfer assembly 10 has moved laterally from a home position to a position aligning the empty cassette frame with the front of the machine to accept the mold for product 'A' (FIG. 6).

Once the extractor arm assembly 410 has fully extended, the feed drawer assembly 114 lowers setting the mold for product 'A' onto the cassette 44 of the mold transfer assembly.

The extractor assembly 410 retracts to allow the mold transfer assembly 10 to move laterally.

The mold transfer assembly 10 moves laterally to align the mold assembly 25 for product 'B' with the machine (FIG. 13).

The mold extractor assembly 410 extends fully forward.

The feed drawer assembly 114 raises, lifting the mold assembly 25 for product 'B' off the cassette 46 of the mold transfer assembly 10.

The extractor assembly 410 retracts fully aligning the mold assembly 25 for product 'B' with the machine.

The mold transfer assembly 10 moves laterally to a home position (FIG. 1).

Concurrently, the feed drawer assembly 114 lowers setting the mold assembly 25 onto the die supports 142, 144.

The fork assembly 442, 444 of the extractor assembly 410 retracts and the feed drawer assembly 114 raises to the new dispensing position for the mold assembly 25 for product 'B'.

Concurrently, the compression beam assembly 126 lowers to the mold head assembly 214.

The mold assembly clamps 150, 152 engage.

The mold head assembly clamps 146, 148 engage.

The compression beam assembly 126 raises the mold head assembly 214.

The compression beam stop blocks 176, 178 extend to an engaged position.

The compression beam assembly 126 lowers onto the compression beam stop blocks 176, 178.

The machine operator initiates the automatic mode of the concrete products machine from the HMI panel 512 and production for product 'B' begins.

This sequence has taken 3 minutes and 20 seconds of time to complete. The mold assemblies 26, 25 for product 'A' and product 'B' are of a different product configuration and height. No spacers have been changed or manual height adjustments been necessary to accomplish this mold change with height change.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. An automated process under control of a computer to remove and replace a mold assembly within a concrete products forming machine of a type having mold assembly mount, a head assembly mount, and a vertically and horizontally moveable feed drawer assembly positioned substantially rearwardly of the mold assembly mount, the process comprising the steps of:

moving an extraction assembly in cooperation with vertical movement of the feed drawer assembly from a raised, retracted position to a lowered, retracted position below a mold assembly when said mold assembly is mounted on mold assembly mounts within the concrete products forming machine;

extending the extraction assembly forwardly in a horizontal plane to a partially extended, lowered position beneath the mold assembly;

raising the extraction assembly into contact with an underside of the mold assembly to a partially extended, partially raised position until the mold assembly is lifted from the mold assembly mounts;

extending the extraction assembly with the lifted mold assembly forwardly in a horizontal plane to a fully extended, partially raised position to a mold transfer assembly arranged perpendicular to a direction of forward movement of the extraction assembly; and lowering the extraction assembly until the mold assembly rests on a first position within the mold transfer assembly.

2. The automated process of claim 1, further comprising the steps of:

moving the mold transfer assembly laterally until a second, replacement mold assembly, mounted at a second position within the mold transfer assembly, is vertically aligned with the extended extraction assembly;

raising the extraction assembly into contact with an underside of the second, replacement mold assembly until the second, replacement mold assembly is lifted from the mold transfer assembly; and retracting the extraction assembly to bring the second, replacement mold assembly into contact with the mold assembly mounts on the concrete products forming machine.

3. The automated process of claim 1, further including the steps of mounting a mold assembly to the concrete products machine including:

setting a mold assembly on shelves within the concrete products machine, said mold box formed of detachable mold box and head assemblies;

lowering a compression beam onto the head assembly;

clamping the head assembly onto the compression beam and clamping the mold box onto the shelves; and raising the head assembly from the mold box.

4. The automated process of claim 3, further including the steps of demounting a mold assembly of a type having a detachable mold box and head assemblies from a concrete products machine including:

lowering the head assembly using the compression beam;

unclamping the head assembly from the compression beam and the mold box from the shelves; and performing the raising step after the unclamping step.

5. The automated process of claim 4, further including the step of interposing under computer control a stop block surface into a lowering path of the compression beam assembly to prevent the head assembly from fully resting on the mold box.

6. The automated process of claim 5, further including the step of moving the stop block surface from an interposed position under computer control during a demounting step.

7. The automated process of claim 2, wherein the first position and the second position are in fixed relation to one another.

8. A method for moving a mold assembly to and from a mounted position within a concrete products forming machine, the method comprising:

extending an extraction assembly forwardly from a retracted position at a rear portion of the concrete products machine to an intermediate extended position so that terminal ends of the extraction assembly are positioned below a carrying surface of the mold assembly;

raising the extraction assembly at the rear portion of the concrete products machine so that the terminal ends of the extraction assembly contact and raise the carrying surface of the mold assembly up off mold mounting surfaces on the concrete products machine; and extending the extraction assembly to a fully extended position so that the mold assembly carried on the terminal ends of the extraction assembly is moved forwardly from the mold mounting surfaces on the concrete products machine to an operative position whereby the mold assembly can be removed from the extraction assembly and replaced with a replacement mold assembly.

9. The method of claim 8, wherein the extraction assembly is of a type including an arm assembly and a pair of telescopically nested fork assemblies slidingly coupled to the arm assembly via a set of tracks.

10. The method of claim 9, wherein the step of extending the extraction assembly to an intermediate extended position includes extending the arm assembly.

11. The method of claim 9, wherein the step of extending the extraction assembly to a fully extended position includes extending the fork assemblies.

12. The method of claim 9, further including the step of slidingly moving the arm assembly and fork assemblies with respect to one another along the tracks via a hydraulic cylinder coupled between the arm assembly and fork assemblies.

13. The method of claim 8, wherein the concrete products forming machine is of a type including a vertically moveable feed box assembly, the method further including coupling the extraction assembly to the feed box assembly and, during the step of raising the extraction assembly, raising the extraction assembly with the feed box assembly.

14. The method of claim 13, wherein the step of raising the extraction assembly further includes operating a set of screw lifts that are part of the feed box assembly to lift the extraction assembly together with the feed box assembly.

15. The method of claim 13, further including the step of mounting the extraction assembly to an underside of the feed box assembly.

16. A method for operating an extraction assembly of a type having an arm assembly and a pair of telescopically nested fork assemblies slidingly coupled to the arm assembly via a set of tracks, the method comprising:

affixing the extraction assembly at a rear portion thereof to a feed box assembly positioned at the rear of a concrete products forming machine; and operating an arm extension assembly and a fork extension assembly to move the arm assembly from the fixed rear portion and the fork assembly from the arm assembly in a common direction of extension and between a fully retracted position, a partially extended position, and a fully extended position, wherein the extraction assembly includes a first hydraulic cylinder coupled between the fixed rear end of the extension assembly and between the arm assembly and a second hydraulic cylinder coupled between the arm assembly and fork assembly, the method including fully extending the second hydraulic cylinder until the extraction assembly is in a partially extended position, and extending the first hydraulic cylinders until the extraction assembly is in a fully extended position.

17. A method for operating an extraction assembly of a type having an arm assembly and a pair of telescopically nested fork assemblies slidingly coupled to the arm assembly via a set of tracks, the method comprising:

affixing the extraction assembly at a rear portion thereof to a feed box assembly positioned at the rear of a concrete products forming machine; and operating an arm extension assembly and a fork extension assembly to move the arm assembly from the fixed rear portion and the fork assembly from the arm assembly in a common direction of extension and between a fully retracted position, a partially extended position, and a fully extended position, further including affixing alignment blocks to top surface of the fork assemblies and vertically moving the extraction assembly to engage said blocks with complementary apertures formed in an underside of a mold assembly.

18. The method of claim 17, wherein the extraction assembly includes a first hydraulic cylinder coupled between the fixed rear end of the extension assembly and between the arm assembly and a second hydraulic cylinder coupled between the arm assembly and fork assembly, the method including fully extending the second hydraulic cylinder until the extraction assembly is in a partially extended position, and extending the first hydraulic cylinders until the extraction assembly is in a fully extended position.

19. The method of claim 16, further including affixing alignment blocks to top surface of the fork assemblies and vertically moving the extraction assembly to engage said blocks with complementary apertures formed in an underside of a mold assembly.

* * * * *